United States Patent [19]

Ikeda et al.

[11] Patent Number: 5,032,500

[45] Date of Patent: Jul. 16, 1991

[54] PROCESS FOR THE PREPARATION OF SILVER HALIDE PHOTOGRAPHIC EMULSION

[75] Inventors: Tadashi Ikeda; Mitsuo Saitou; Yoshio Inagaki; Toshinao Ukai, all of Kanagawa, Japan

[73] Assignee: Fuji Photo Film Co., Ltd., Kanagawa, Japan

[21] Appl. No.: 469,871

[22] Filed: Jan. 14, 1990

[30] Foreign Application Priority Data

Jan. 25, 1989 [JP] Japan ..... 1-15754

[51] Int. Cl.[5] ..... G03C 1/02; G03C 1/08

[52] U.S. Cl. ..... 430/570; 430/578; 430/579; 430/580; 430/581; 430/583; 430/585; 430/588; 430/589; 430/592; 430/594; 430/595; 430/607; 430/613; 430/614; 430/569

[58] Field of Search ..... 430/570, 578, 579, 580, 430/581, 583, 585, 588, 589, 592, 594, 595, 607, 613, 614, 569

[56] References Cited

U.S. PATENT DOCUMENTS 4,040,825 8/1977 Steiger et al. ..... 430/583

4,225,666 9/1980 Locker et al. ..... 430/581

*Primary Examiner*—Charles L. Bowers, Jr.

*Assistant Examiner*—Thorl Chea

*Attorney, Agent, or Firm*—Sughrue, Mion, Zinn, Macpeak & Seas

[57] ABSTRACT

A process or the preparation of a silver halide photographic emulsion is provided which comprises the addition of at least one pendant type spectral sensitizing dye containing as a substituent a compound having the effect of inhibiting fog at any time after the formation of silver halide grains, but before the completion of the chemical ripening process. In a preferred embodiment, the addition of said pendant type spectral sensitizing dyes is effected at any time after the formation of silver halide grains, but before former one second of the total time of the chemical ripening process. The pendant type spectral sensitizing dyes are compounds represented by the general formula (III) or (IV):

$$(SSD)_{l^1}(L^1)_{l^2}(AF)_{\beta} \quad \text{(III)}$$

$$-(SSD)L^1-\left[\begin{matrix}(AF)-L^1- \\ -L^2-(AF)_{\beta}-L^2-(SSD)-\end{matrix}\right]_{l^4} \quad \text{(IV)}$$

wherein SSD represents a sensitizing dye portion; AF represents a compound portion containing a saturated or unsaturated 5- to 7-membered ring containing at least one nitrogen atom; $L^1$ represents a divalent connecting group containing at least one of C, N, S and O; $L^2$ has the same meaning at $L^1$ and does not connect SSD and AF; $l^1$, $l^2$ and $l^3$ each represents an integer 1 to 3, $l^2$ being equal to $l^1$ or $l^3$; $l^4$ represents an integer 0 to 3; and $l^5$ represents an integer 0 or 1, with the proviso that when there is a plurality of $L^1$'s, $L^2$'s, SSD's or AF's, they may be the same or different and that when none of $L^2$'s adjacent to $l^5$ connect SSD and AF, $l^5$ represents 0.

6 Claims, No Drawings

PROCESS FOR THE PREPARATION OF SILVER HALIDE PHOTOGRAPHIC EMULSION

FIELD OF THE INVENTION

The present invention relates to a process for the preparation of a spectrally sensitized silver halide emulsion. More particularly, the present invention relates to a process for the preparation of a spectrally sensitized silver halide photographic emulsion which comprises the addition of a pendant type spectral sensitizing dye containing as a substituent a compound having the effect of inhibiting fog at a time before the completion of the process for chemical ripening of silver halide grains.

BACKGROUND OF THE INVENTION

In the field of silver halide photographic emulsions, spectral sensitization is a technique for extending the sensitivity range of silver halide grains from their inherent spectral absorption range to long wavelength range such as the visible light range and the infrared range. Spectral sensitization is therefore essential for the preparation of silver halide photographic materials. On the other hand, high sensitivity and high quality silver halide photographic materials are still highly desired. Furthermore, with the recent remarkable progress in many fields such as electronics, as represented by the development of various light sources such as LED, laser and CRT, silver halide photographic materials suited for these light sources are now desired. Thus, silver halide photographic materials suited for various systems are desired.

To prepare spectrally sensitized silver halide emulsions, a sensitizing dye is normally incorporated during the time following the completion of the chemical ripening of the silver halide emulsions, but before the coating thereof on a proper support. However, some kinds of silver halide grains or sensitizing dyes often undergo a sensitivity change during their storage after the addition of a sensitizing dye, but before coating or during the storage after coating. It has been desired to overcome this difficulty, and many approaches have been proposed. For example, methods disclosed in U.S. Pat. Nos. 2,735,766, 3,628,960, 4,183,756 and 4,225,666 propose the addition of a sensitizing dye during the formation of silver halide grains before the completion of the grain formation process. Methods disclosed in U.S. Pat. No. 4,442,201 (corresponding to JP-A-58-7629 (the term "JP-A" as used herein refers to a "published unexamined Japanese patent application")) and JP-A-59-9658, JP-A-59-48756 and JP-A-59-113920 propose the addition of a sensitizing dye before or during chemical ripening of silver halide grains. It is said that the use of these approaches enables not only an increase in photographic sensitivity but also an improvement in the adsorption of a sensitizing dye by silver halide grains, eliminating the desensitization which otherwise occurs during the storage of a silver halide emulsion in the solution state before coating. Thus, these approaches are often used.

However, even these approaches leave much to be desired. In these approaches, photographic desensitization occurring during the storage of a spectrally sensitized emulsion in the solution state before coating or during the storage of the emulsion after coating cannot be often substantially eliminated. Furthermore, it is often observed that fog is more developed than is the case where a sensitizing dye is incorporated after the completion of chemical ripening.

In order to inhibit fogging during storage of a silver halide photographic material or during chemical ripening or to prevent an increase in fogging during development, most silver halide photographic materials normally contain a so-called fog inhibitor (called an "emulsion stabilizer" for the former purpose or a "development inhibitor" for the prevention of fog during development). Like the spectral sensitization technique, this fog inhibition process is essential for the preparation of silver halide photographic materials.

If an effective amount of such a fog inhibitor is used to inhibit fog caused by the above mentioned approaches, a remarkable sensitivity drop or a remarkable desensitization increase during the storage of the materials occurs. This eliminates the disclosed advantages. Furthermore, the results are often poorer than is the case where a sensitizing dye is incorporated after chemical ripening. Thus, it has been difficult to use these approaches.

The adsorption of a sensitizing dye by silver halide grains is often competitive with the adsorption of a fog inhibitor by silver halide grains. Therefore, the sensitizing dye may be desorbed by the fog inhibitor, or the fog inhibitor may be in turn desorbed by the sensitizing dye. The former phenomenon causes a spectral sensitivity drop, and the latter causes a fog increase. This competition means that the photographically most desirable sensitizing dye and fog inhibitor cannot be freely selected.

In general, the adsorption of an ordinary cyanine dye by silver halide grains is mainly based on van der Waals forces. It has been observed that as the polarizability of the base decreases, these forces decrease. In particular, the adsorption decreases in the order of AgI, AgBr and AgCl. On the other hand, most fog inhibitors are adsorbed by silver halide grains more strongly to the extent that the solubility product (Ksp) of their silver salts or silver complexes is smaller than the solubility product of silver halide. Therefore, it is known that if the same fog inhibitor is used, it can be adsorbed more strongly by AgBr than by AgI and more strongly by AgCl than by AgBr. Accordingly, if a silver halide emulsion comprising a high surface Cl content is used, a fog inhibitor tends to desorb a cyanine dye. Therefore, even if the above mentioned techniques for the addition of a cyanine dye are used, desorption of a cyanine dye can be easily caused, resulting in a sensitivity drop. Furthermore, a sensitizing dye belonging to a so-called merocyanine dye or a complex cyanine dye is similarly competitive with a fog inhibitor for adsorption by silver halide grains.

It has been proposed that the captured quantity of light be increased to improve the sensitivity in the wavelength range of absorption of a sensitizing dye by a silver halide emulsion. In this respect, it is advantageous to use tablet grains having a large specific surface area as disclosed in JP-A-58-127921 and JP-A-58-113927. However, even with the use of these silver halide grains, as the percentage of adsorption of a sensitizing dye increases, the inherent sensitivity of the emulsion decreases. Even if the captured quantity of light is increased accordingly, the efficiency of sensitization by the sensitizing dye decreases. The resulting photographic sensitivity is not necessarily high enough. One of the reasons for this trouble is probably that the aggregates formed by the excessive aggregation of sensitizing dyes can easily serve as electron trapping centers. The above mentioned approaches which comprise the addition of a sensitizing dye before the completion of chemical ripening often make it easier to form excessive aggregates of sensitizing dyes on the surface of silver halide grains than do the approaches which comprise the addition of a sensitizing dye after the completion of chemical ripening.

Most of the high aspect ratio tabular grains have a (111) plane as the main plane. However, most sensitizing dyes are adsorbed more weakly by a (111) plane than the (100) plane of AgBr, AgBrCl or AgCl grains. Accordingly, if such silver halide grains having a (111) plane are used, desorption can be caused not only by a fog inhibitor but also by a coupler or its emulsion dispersion or a surface active agent as coating aid to be used in color light-sensitive materials. This can cause a photographic sensitivity drop during the storage of a spectrally sensitized emulsion in the solution state before coating or during the storage of the emulsion after coating.

As a result of intensive studies to change the adsorption of a sensitizing dye and a fog inhibitor by silver halide grains from competitive to cooperative relationship, the inventors have discovered a process to overcome these problems. In particular, the inventors found a process for the preparation of a silver halide photographic emulsion which provides a high spectral sensitivity without generation of fog and enables the remarkable elimination of a sensitivity drop of a spectrally sensitized emulsion during the storage in the solution state before coating and during the storage thereof after coating.

SUMMARY OF THE INVENTION

It is, therefore, an object of the present invention to provide a process for the preparation of an improved silver halide photographic emulsion which exhibits a high spectral sensitizing effect without generation of fog and improves the adsorption of a sensitizing dye.

It is another object of the present invention to provide a process for the preparation of an improved silver halide photographic emulsion which exhibits a high spectral sensitizing effect and inhibits the photographic sensitivity drop of an emulsion which has been stored in the solution state before coating and during the storage after coating.

It is a further object of the present invention to provide a process for the preparation of an improved silver halide photographic emulsion which exhibits a high spectral sensitizing effect and inhibits desensitization by a sensitizing dye.

It is a still further object of the present invention to provide a process for the preparation of an improved silver halide photographic emulsion which exhibits a high spectral sensitizing effect and inhibits fogging during high temperature development and rapid development.

These objects of the present invention are accomplished by a process for the preparation of a spectrally sensitized silver halide photographic emulsion, which comprises addition of at least one pendant type spectral sensitizing dye (hereinafter referred to as "pendant dye") containing as a substituent a compound having an effect of inhibiting fog at a time before the completion of chemical ripening process. The pendant dye referred to herein is further described in JP-A-1-158425 to the inventors of the present application and Japanese Patent Application No. 63-311518 to the assignee of the present application. The former Japanese patent application discloses that objects similar to that of the present invention can be accomplished.

However, it was found that the present invention makes it possible to prepare a further improved spectrally sensitized silver halide photographic emulsion.

These and other objects of the present invention will become more apparent from the following detailed description and examples.

DETAILED DESCRIPTION OF THE INVENTION

The sensitizing dye portion which is chemically connected to the rest of the pendant dye and which allows a compound having the effect of inhibiting fog to be contained as a substituent therein is a methine dye which is commonly used as a spectral sensitizer for silver halide photographic emulsions, such as cyanine dyes, merocyanine dyes, composite cyanine dyes, composite merocyanine dyes, holopolar cyanine dyes, hemicyanine dyes, hemioxonol dyes and styryl dyes. The range of color to which these sensitizing dyes are sensitive may encompass any of the blue, green, red or infrared ranges. Methine dyes are represented by the general formulae (I-1), (I-2) and (I-3):

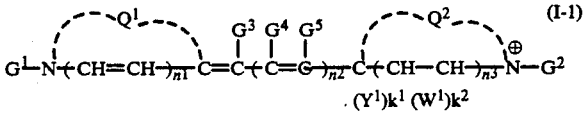

(I-1)

wherein $Q^1$ and $Q^2$ may be the same or different and each represents an atomic group required to form a 5- or 6-membered nitrogen-containing heterocyclic group on which at least one substituent may be present.

More preferably, $Q^1$ and $Q^2$ each represents an atomic group required to form a basic heterocyclic group contained in ordinary cyanine dyes such as oxazoline, oxazole, benzoxazole, naphthoxazole, thiazoline, thiazole, benzothiazole, naphthothiazole, dihydronaphthothiazole, selenazoline, selenazole, benzoselenazole, naphthoselenazole, 3H-indole, benzindole, imidazoline, imidazole, benzimidazole, naphthoimidazole, pyridine, quinoline, imidazo[4,5-b]quinoxaline, pyrrolidine, tellurazole, benzotellurazole, and naphthotellurazole. The above mentioned heterocyclic groups may include one or more substituents thereon. Examples of such substituents include hydroxyl groups, halogen atoms, lower alkyl groups (preferably containing 10 or less carbon atoms), substituted alkyl groups (preferably containing 12 or less carbon atoms; preferred examples of substituents include a hydroxyl group, an alkoxy group, a halogen atom, an acyl group, an acylamino group, an aryl group, an aryloxy group, an alkoxycarbonyl group, and a carboxyl group), aryl groups (preferably a phenyl group, a furyl group, a pyridyl group, and a thienyl group), substituted aryl groups (preferably containing 10 or less carbon atoms; preferred examples of substituents include those described with reference to the above mentioned substituted alkyl group), lower alkoxy groups (preferably containing 8 or less carbon atoms), lower substituted alkoxy groups (preferably containing 10 or less carbon atoms; preferred examples of substituents include those described with reference to the above mentioned substituted alkyl group), lower alkylthio groups (preferably 8 or less carbon atoms), arylthio groups (preferably a phenylthio group), methylenedioxy groups, cyano groups, acylamino groups (preferably containing 8 or less carbon atoms), carboxyl groups, lower alkoxycarbonyl groups (preferably containing 8 or less carbon atoms), acyl groups (preferably an acyl group containing 10 or less carbon atoms such as an acetyl group, a methylsulfonyl group and a benzoyl group), and nitro groups.

$G^1$ and $G^2$ may be the same or different and each represents an alkyl, aryl, alkenyl or heterocyclic group which may be substituted or unsubstituted. Examples of these alkyl and alkenyl groups include an unsubstituted $C_{1-18}$, preferably a $C_{1-8}$ alkyl group, an alkenyl group (e.g., methyl, ethyl, propyl, isopropyl, butyl, hexyl, octyl, dodecyl, octadecyl, allyl, 2-butenyl), and a $C_{1-18}$, preferably a $C_{1-10}$ substituted alkyl group, a substituted alkenyl group (e.g., benzyl, phenethyl, p-sulfo-2-phenethyl, 2-hydroxyalkyl, 3-hydroxypropyl, 2-carboxyethyl, 3-carboxypropyl, 2-methoxyethyl, 2-(2-methoxyethoxy)ethyl, 2-sulfoethyl, 3-sulfopropyl, 3-sulfobutyl, 4-sulfobutyl, 2-(3-sulfopropoxy)ethyl, 2-hydroxy-3-sulfopropyl, 3-sulfatopropyl, 2-hydroxy-3-sulfopropyl, 2-(pyrrolidine-2-one-1-yl)ethyl, tetrafurfuryl, 2-acetoxyethyl, ethoxycarbonylmethyl, 3-cyanopropyl, 2-methanesulfonylaminoethyl, 2-carbamoylethyl, 2,2,3,3-tetrafluoropropyl, 2-ethylthioethyl, 2-chloro-2-butenyl). Examples of these aryl and heterocyclic groups include aryl and heterocyclic groups containing 18 or less carbon atoms, preferably 10 or less carbon atoms (e.g., phenyl, tolyl, anisyl, sulfophenyl, carboxyphenyl, p-ethoxycarbonylphenyl, 3-hydroxyphenyl, acetylaminophenyl, 3-chloro-p-tolyl, naphthyl, 2-furyl, 2-pyridyl, 3-pyridyl, 4-pyridyl, 3-chloro-2-pyridyl).

$G^3$ represents a hydrogen atom or a fluorine atom. Furthermore, if $n^2$ is 1 or more, $G^3$ represents a lower alkyl group which may be substituted (preferably containing 6 or less carbon atoms). Moreover, $G^3$ may be alkenically crosslinked to $G^1$ to form a 5- or 6-membered ring which may contain oxygen, sulfur or nitrogen atoms therein.

$G^4$ and $G^5$ each represents a hydrogen atom, a lower alkyl group which may be substituted (preferably containing 8 or less carbon atoms), a lower alkoxy group which may be substituted (preferably containing 6 or less carbon atoms), or an aryl group which may be substituted (preferably containing 12 or less carbon atoms). Furthermore, if $n^2$ is 2 or more, $G^3$ and the nearest $G^5$ and/or $G^4$ and another $G^4$ and/or $G^5$ and another $G^5$ may be connected to each other to form a 5- or 6-membered ring which may contain oxygen, sulfur or nitrogen atoms therein.

The suffixes $n^1$ and $n^3$ each represents the integer 0 or 1. The suffixes $n^2$ represents an integer from 0 to 4.

$Y^1$ represents a cationic group. $W^1$ represents an anionic group. The suffixes $k^1$ and $k^2$ each represents the integer 0 or 1. The suffixes $k^1$ and $k^2$ depend on the absence or presence of ionic groups in the methine dye.

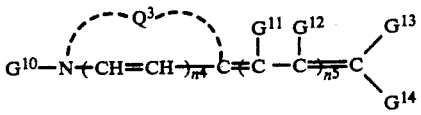

(I-2)

wherein $Q^3$ has the same meaning as either $Q^1$ or $Q^2$ in the general formula (I-1); and $G^{10}$ has the same meaning as either $G^1$ or $G^2$ in the general formula (I-1).

$G^{11}$ and $G^{12}$ each represents a hydrogen atom, a lower alkyl group which may be substituted (preferably containing 9 or less carbon atoms), a lower alkoxy group which may be substituted (preferably containing 7 or less carbon atoms), an aryl group which may be substituted (preferably containing 10 or less carbon atoms) or a halogen atom. Furthermore, the nearest $G^{11}$ and $G^{10}$ may be connected to the heterocyclic group represented by $Q^3$; and/or, if $n^5$ represents an integer 2 or more, $G^{11}$ and another $G^{11}$ and/or $G^{12}$ and another $G^{12}$ may be connected to each other to form a 5- or 6-membered ring which may contain nitrogen, oxygen or sulfur atoms therein.

$G^{13}$ and $G^{14}$ may be the same or different and each represents an electron attractive group. Examples of such an electron attractive group include a cyano group, an alkylsulfonyl group, an arylsulfonyl group, a carboxy group, an alkylcarbonyl group, an arylcarbonyl group, an alkoxycarbonyl group, an aryloxycarbonyl group, a 5- or 6-membered nitrogen-containing heterocyclic group, an alkylaminosulfonyl group, an arylaminosulfonyl group, an alkylaminocarbonyl group, and an arylaminocarbonyl group. $G^{13}$ and $G^{14}$ may also together represent an atomic group required to complete a cyclic acidic nucleus which is commonly contained in merocyanine dyes or oxonol dyes such as 2,4-oxazolidinedione, 2,4-thiazolrdinedione, 2-thio-2,4-oxazolidinedione, rhodanines, hydantoin, 2-thiohydantoin, 2-pyrazoline-5-ones, 2-ixooxazoline-5-ones, 3,5-pyrazolidinedione, 1,3-indanedione, 1,3-dioxane-4,6-dione, 1,3-cyclohexanedione, 2-thioselenazolidine-2,4-diones, barbituric acid, and 2-thiobarbituric acid.

The suffix $n^4$ represents an integer 0 or 1. The suffix $n^5$ represents an integer from 0 to 4.

The spectral sensitizer represented by the general formula (I-2) is preferably one wherein $G^{13}$ and $G^{14}$ together represent 2-thiooxazolidine-2,4-diones, rhodanines, 2-thiohydantoins, or 2-thioselenazolidine-2,4-diones.

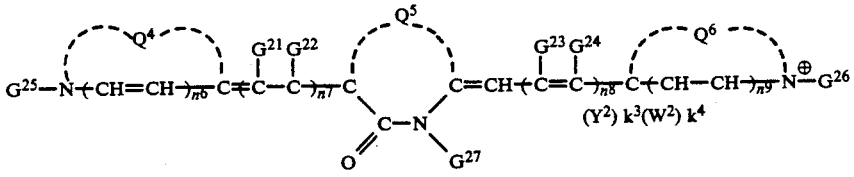

(I-3)

wherein $Q^4$ and $Q^6$ each has the same meaning as either $Q^1$ or $Q^2$ in the general formula (I-1).

$Q^5$ represents an atomic group required to form a nitrogen-containing 5-membered ring. Examples of such a nitrogen-containing 5-membered ring include 4-oxooxazolidine, 4-oxothiazolidine, 4-oxoimidazolidine, and 4-oxoselenazolidine.

$G^{21}$ and $G^{22}$ have the same meaning as $G^{11}$ and $G^{12}$ in the general formula (I-2), respectively. $G^{23}$ and $G^{24}$ have the same meaning as $G^4$ and $G^5$ in the general formula (I-1), respectively.

$G^{25}$ and $G^{26}$ each has the same meaning as either $G^1$ or $G^2$ in the general formula (I-1). $G^{27}$ represents a lower alkyl group (preferably containing 16 or less carbon atoms), an aryl group (preferably containing 14 or less carbon atoms), a heterocyclic group (preferably monocyclic group containing 12 or less carbon atoms), or an alkenyl group. These groups may be substituted or unsubstituted.

The suffixes $n^6$ and $n^9$ each represents an integer 0 or 1. The suffix $n^7$ represents an integer from 0 to 3. The suffix $n^8$ represents an integer from 0 to 3. Preferably, the sum of $n^7$ and $n^8$ is 4 or less.

$Y^2$ represents a cationic group. $W^2$ represents an anionic group. The suffixes $k^3$ and $k^4$ each represents an integer 0 or 1. The suffixes $k^3$ and $k^4$ depend on the presence or absence of ionic substituents.

The compound having the effect of inhibiting fog to be connected to the sensitizing dye portion of the pendant dye is a so-called fog inhibitor which is normally used as a fog inhibitor, an emulsion stabilizer or a development inhibitor for silver halide photographic emulsion.

A suitable fog inhibitor to be contained in the pendant dye is a compound containing a saturated or unsaturated 5- to 7-membered ring comprising at least one nitrogen atom as a hetero atom. This ring may further contain substituents or condensed rings and may further contain hetero atoms other than the nitrogen atom.

A more preferred compound is one represented by the general formula (II-1) or (II-2).

$$Z^1(V^1)_{m1} \qquad \text{(II-1)}$$

wherein $Z^1$ represents an azole ring (e.g., imidazole, triazole, tetrazole, thiazole, oxazole, selenazole, benzimidazole, benzindazole, benzotriazole, benzoxazole, benzothiazole, thiadiazole, oxadiazole, benzoselenazole, pyrazole, naphthothiazole, naphthoimidazole, naphthoxazole, azabenzimidazole, purine), a pyrimidine ring, a triazine ring, a pyridine ring, or an azaindene ring (e.g., triazaindene, tetraazaindene, pentaazaindene).

$V^1$ represents a hydrogen atom or a substituent. Specific examples of such a substituent include a substituted or unsubstituted alkyl group (e.g., methyl, ethyl, hydroxyethyl, trifluoromethyl, sulfopropyl, dipropylaminoethyl, adamantyl, benzyl, p-chlorophenethyl, ethoxyethyl, ethylmercaptoethyl, cyanopropyl, phenoxyethyl, carbamoylethyl, carboxyethyl, ethoxycarbonylpropyl, acetylaminoethyl), a substituted or unsubstituted alkenyl group (e.g., allyl), a substituted or unsubstituted aryl group (e.g., phenyl, naphthyl, p-carboxyphenyl, 3,5-dicarboxyphenyl, m-sulfophenyl, p-acetamidophenyl, 3-caprylamidophenyl, p-sulfamoylphenyl, m-hydroxyphenyl, p-nitrophenyl, 3,5-dichlorophenyl, p-anisyl, o-anisyl, p-cyanophenyl, p-N'-methylureidophenyl, m-fluorophenyl, p-tolyl, m-tolyl), a substituted or unsubstituted heterocyclic residue (e.g., pyridyl, 5-methyl-2-pyridyl, thienyl), a halogen atom (e.g., chlorine, bromine), a mercapto group, a cyano group, a carboxyl group, a sulfo group, a hydroxyl group, a carbamoyl group, a sulfamoyl group, an amino group, a nitro group, a substituted or unsubstituted alkoxy group (e.g., methoxy, ethoxy, 2-methoxyethoxy, 2-phenylethoxy), a substituted or unsubstituted aryloxy group (e.g., phenoxy, p-methylphenoxy), an acyl group (e.g., acetyl, benzoyl, methanesulfonyl), an acylamino group (e.g., acetylamino, caproylamino, methylsulfonylamino), a substituted amino group (e.g., diethylamino, hydroxyamino), an alkyl or arylthio group (e.g., methylthio, carboxyethylthio, sulfobutylthio), an alkoxycarbonyl group (e.g., methoxycarbonyl), and an aryloxycarbonyl group (e.g., phenoxycarbonyl).

The suffix $m^1$ represents an integer from 1 to 5. This means that there may be a plurality of the same or different substituents represented by $V^1$.

$$(V^2)_{m2}Z^2\text{—S—S—}Z^2(V^2)_{m2} \qquad \text{(II-2)}$$

wherein $Z^2$ has the same meaning as $Z^1$ in the general formula (II-1); $V^2$ has the same meaning as $V^1$ in the general formula (II-1); and $m^2$ has the same meaning as $m^1$ in the general formula (II-1).

Further preferred examples of the compounds represented by the general formulae (II-1) and (II-2) include azaindenes, azoles and azoles containing mercapto groups.

Preferable examples of the fog inhibitor to be connected to the sensitizing dye portion of the pendant dye are a symmetric and asymmetric compounds obtained by chemically connecting compounds represented by the general formula (II-1) or (II-2) by a divalent connecting group. A compound represented by general formula (II-1) may be chemically connected to a second compound represented by general formula (II-1); a compound represented by general formula (II-1) may be chemically connected to a compound represented by general formula (II-2); or a compound represented by general formula (II-2) may be chemically connected to a compound represented by general formula (II-2). Examples of such a divalent connecting group include an alkylene, an arylene, an alkenylene, —$SO_2$—, —SO—, —O—, —S—, —CO—, $$\text{—}\underset{\underset{R}{|}}{N}\text{—}$$

(in which R represents an alkyl group, an aryl group or a hydrogen atom), a heterocyclic divalent group and a divalent connecting group containing 20 or less carbon atoms formed by combining heterocyclic divalent groups. Examples of such a symmetric or asymmetric compound include tetraazaindene compounds as described in JP-A-61-14630.

There are many specific examples of these sensitizing dyes and fog inhibitors. For details, reference can be made to JP-A-61-14630, JP-A-62-6251, JP-A-62-42148, JP-A-58-113926, JP-A-58-113927, JP-A-58-113928 and JP-A-62-73251, *Research Disclosure,* Vol. 176 (Item 17643) (December, 1978), Vol. 184 (Item 18431) (August, 1979), and Vol. 216 (Item 21728) (May, 1982), *The Chemistry of Heterocyclic Compounds,* Vol. 18, A. Weissberger ed., *Interscience,* New York (1964) and Vol 30, A. Weissberger and E.C. Taylor eds., John Wiley, New York, 1977, T.H. James, *The Theory of the Photographic Process,* Fourth Edition, Macmillan, New York, 1977, Chap. 1, 8–10, 11, 13, P. Glafkides, *Chimie et Physique Photographiques,* Fifth Edition, Edition de l'usine Nouvelle, Paris, Section 6 (1987), (Reports on the Progress of Applied Chemistry), Vol. 59, pp. 159 (1974), JP-B-48-34169, JP-B-47-18008 and JP-B-49-23368 (the term "JP-B" as used herein refers to an "examined Japanese patent publication"), *Yakugaku Zasshi,* Vol. 74, pages 1,365–1,369 (1954), *Beilstein*, Chap. XII, page 394, Chap. IV, page 121, E.J. Birr, *Stabilization of Photographic Silver Halide Emulsion*, Focal Press, London, 1974 and the references cited therein, P. Wulff and B. Wendt, *Ger.*, 445, 753 (1926), JP-A-2-000042, and Nihon Kagakukai, *Shinjikken Kagaku Koza* 14 (*Synthesis and Reaction of Organic Compounds IV*), Maurezen, Tokyo (1978).

The pendant dye of the present invention will be further described hereafter.

A suitable pendant dye in the present invention is a compound represented by the general formula (III) or (IV):

$$(SSD)_{l1}(L^1)_{l2}(AF)_{l3} \quad \text{(III)}$$

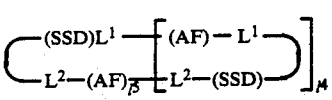

(IV)

wherein SSD represents a sensitizing dye portion, preferably a sensitizing dye portion represented by the general formula (I-1), (I-2) or (I-3).

AF represents a compound portion containing a saturated or unsaturated 5- to 7-membered ring which comprises at least one nitrogen atom and may comprise hetero atoms other than the nitrogen atom, preferably a fog inhibitor portion represented by the general formula (II-1) or (II-2).

$L^1$ represents a divalent connecting group which is an atom or an atomic group comprising at least one C, N, S or O atom.

Specific examples of such a divalent connecting group include alkylene, arylene, alkenylene, alkinylene, $-SO_2-$, $-SO-$, $-S-$, $-O-$, $-CO-$, $$-\underset{\underset{R^1}{|}}{N}-$$

(in which $R^1$ represents an alkyl group, an aryl group or a hydrogen atom), a heterocyclic divalent group, and a divalent connecting group containing 20 or less carbon atoms formed by combining heterocyclic divalent groups.

$L^2$ has the same meaning as $L^1$ and does not connect SSD and AF (in the case where ring opening takes place at $L^2$).

The suffixes $l^1$, $l^2$ and $l^3$ each represents an integer from 1 to 3, with the proviso that $l^2$ equals $l^1$ or $l^3$ and that when $l^1$ or $l^2$ is 2 or more, the SSD compounds may be the same or different and the AF compounds may be the same or different. More preferably, $l^1$, $l^2$ and $l^3$ each represents an integer 1 or 2, with the proviso that the ratio of $l^1$ to $l^3$ is in the range of 2/1 to ½.

The suffix $l^4$ represents an integer from 0 to 3. If $l^4$ is 1 or more, the $L^1$ compounds, the $L^2$ compounds, the SSD compounds and the AF compounds may be the same or different. The suffix $l^5$ represents an integer 0 or 1. If none of the $L^2$'s adjacent to $l^5$ connects SSD and AF, $l^5$ is 0. More preferably, $l^4$ is 0 or 1.

The pendant dye will be further described hereafter.

If the SSD represented by the general formula (III) or (IV) is a cyanine dye, the cyanine dye portion is preferably represented by the general formula (V). If SSD is a merocyanine dye, the merocyanine dye portion is preferably represented by the general formula (VI).

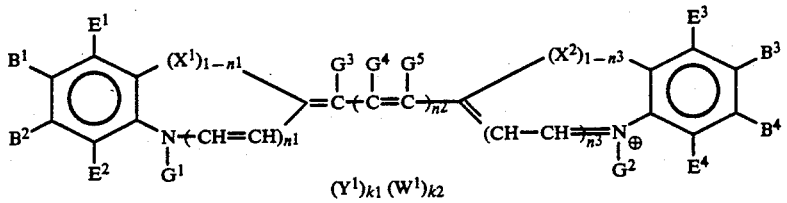

(V)

wherein $X^1$'s and $X^2$'s may be the same or different, respectively, and each represents a sulfur atom, an oxygen atom, —CH=CH—, a selenium atom, $>N-R^3$ (in which $R^3$ represents a lower alkyl group, an allyl group, an aryl group, the above mentioned divalent connecting group $L^1$ or $L^2$ or a bond), or $>C(CH_3)_2$.

$G^1$, $G^2$, $G^3$, $G^4$ and $G^5$ have the same meaning as $G^1$, $G^2$, $G^3$, $G^4$ and $G^5$ in the general formula (I), respectively, or each represents the above mentioned divalent connecting group or a bond.

The suffixes $n^2$, $k^1$ and $k^2$, $Y^1$ and $W^1$ have the same meaning as $n^2$, $k^1$, $k^2$, $Y^1$ and $W^1$ in the general formula (I), respectively. The suffixes $n^1$ and $n^3$ each represents an integer 0 or 1.

$B^1$, $B^2$, $B^3$, $B^4$, $E^1$, $E^2$, $E^3$ and $E^4$ have the same meaning as the substituents which may be contained in the heterocyclic group containing $Q^1$ or $Q^2$ as the constituent atomic group in the general formula (I-1) or each represents a hydrogen atom, the above mentioned divalent connecting group $L^1$ or $L^2$ or a bond.

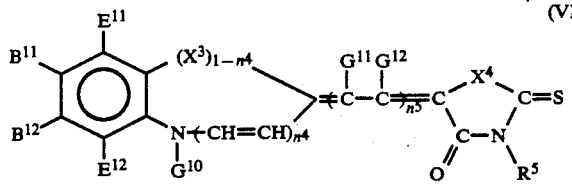

(VI)

wherein $G^{10}$, $G^{11}$, $G^{12}$, $n^4$ and $n^5$ have the same meaning as $G^{10}$, $G^{11}$, $G^{12}$, $n^4$ and $n^5$ in the general formula (I-2), respectively.

$X^3$ has the same meaning as $X^1$ in the general formula (V).

$X^4$ represents an oxygen atom, a sulfur atom or $>N-R^4$ in which $R^4$ has the same meaning as $G^1$ or $G^2$ in the general formula (I-1).

$R^5$ has the same meaning as $G^1$ or $G^2$ in the general formula (I-1).

$B^{11}$, $B^{12}$, $E^{11}$ and $E^{12}$ have the same meaning as the substituents which may be contained in the heterocyclic group containing $Q^3$ as a constituent atomic group in the general formula (I-2) or each represents a hydrogen atom, the above mentioned divalent connecting group $L^1$ or $L^2$ or a bond.

In the general formula (III) or (IV), AF represents a compound portion containing a saturated or unsaturated 5- to 7-membered ring which contains at least one nitrogen atom and may contain hetero atoms other than a nitrogen atom (e.g., oxygen, sulfur, selenium, tellurium), preferably a fog inhibitor portion represented by the general formula (II-1) or (II-2).

Specific examples of a fog inhibitor portion represented by AF will be described with reference to the general formulae (VII) to (XI), but the present invention should not be construed as being limited thereto.

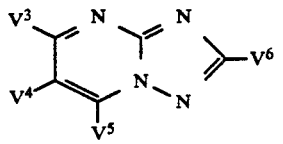

(VII)

wherein $V^3$, $V^4$, $V^5$ and $V^6$ each has the same meaning as $V^1$ in the general formula (II-1) and each may further contain the above mentioned divalent connecting group L or a bond. $V^3$, $V^4$, $V^5$ and $V^6$ each may also represent a divalent connecting group Lor $L^2$ or a bond.

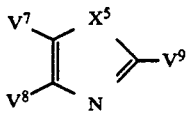

(VIII)

wherein $X^5$ represents an oxygen atom, a sulfur atom or $>N—R^6$.

$R^6$ represents a hydrogen atom, a substituted or unsubstituted alkyl group, a substituted or unsubstituted aryl group, or a substituted or unsubstituted heterocyclic group.

$V^7$, $V^8$ and $V^9$ each has the same meaning as $V^1$ in the general formula (II-1) or represents the above mentioned divalent connecting group $L^1$ or $L^2$ or a bond.

$V^7$and $V^8$ may together form a benzo or naphtho condensed ring.

These benzo and naphtho condensed rings and the group represented by $R^6$ (excluding the hydrogen atom) may be substituted by the substituents and/or the connecting group $L^1$ or $L^2$ (or a bond) described with reference to $V^1$ in the general formula (II-1).

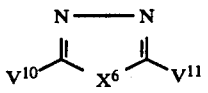

(IX)

wherein $X^6$ represents an oxygen atom, a sulfur atom or $N—R^7$ in which $R^7$ has the same meaning as $R^6$ in the general formula (VIII).

$V^{10}$ and $V^{11}$ each has the same meaning as $V^1$ in the general formula (II-1) or represents the above mentioned connecting group $L^1$ or $L^2$ or a bond.

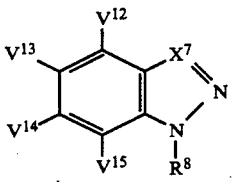

(X)

wherein $X^7$ represents a nitrogen atom or $C—R^9$.

$R^8$ and $R^9$ each has the same meaning as $R^6$ in the general formula (VIII). $V^{12}$, $V^{13}$, $V^{14}$ and $V^{15}$ each has the same meaning as $V^{10}$ or $V^{11}$ in the general formula (IX).

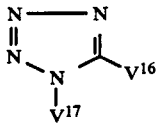

(XI)

wherein $V^{16}$ and $V^{17}$ have the same meaning as $V^{10}$ and $V^{11}$ in the general formula (IX), respectively.

The pendant dye is a compound obtained by chemically bonding at least one of $B^1$, $B^2$, $B^3$, $B^4$, $E^1$, $E^2$, $E^4$, $G^1$, $G^3$, $G^4$, $G^5$ and $R^3$ (if the pendant dye is a cyanine dye represented by the general formula (V)) or at least one of $B^{11}$, $B^{12}$, $E^{11}$, $E^{12}$, $G^{10}$, $G^{11}$, $G^{12}$, $R^3$, $R^4$, and $R^5$ (if the pendant dye is a merocyanine dye represented by the general formula (VI)) to at least one of $V^3$ to $V^{17}$ and $R^6$ to $R^9$ groups of the fog inhibitors represented by the general formulae (VI) to (X) via the above mentioned divalent connecting group $L^1$ or $L^2$ or a bond. The position at which these components are bonded to the cyanine dye represented by the general formula (V) is preferably $G^2$, $G^3$, $B^1$, $B^2$, $B^3$ or $B^4$. The position at which these components are bonded to the merocyanine dye represented by the general formula (VI) is preferably $R^3$, $R^4$, $R^5$, $G^{10}$, $G^{11}$ or $B^{12}$.

If the sensitizing dye to be bonded to a fog inhibitor as a pendant dye is a compound represented by the general formula (I-1), (I-2) or (I-3), the position at which these components are bonded is preferably any position except on a methine chain which forms a conjugated system, more preferably any position which does not sterically prevent the adsorption of the sensitizing dye portion by silver halide grains.

The synthesis of the pendant dye of the present invention can be accomplished by any suitable method such as (1) a method which comprises the connection of a sensitizing dye portion and a fog inhibitor portion utilizing a bond-forming reaction well known in the field of organic compounds such as amide bond-forming reaction and ester bond-forming reaction, (2) a method which comprises connecting a fog inhibitor portion to a starting material and an intermediate of a sensitizing dye and then subjecting the material to a reaction for conversion to a dye, and (3) a method which comprises connecting a starting material and an intermediate of a fog inhibitor portion to a sensitizing dye portion and then synthesizing a fog inhibitor portion. For the synthesis reaction for connection, reference can be made to many literature references concerning organic synthesis reaction, e.g., Nihon Kagakukai, *Shinjikken Kagaku Koza* 14 (Synthesis and Reaction of Organic Compounds), Vols. I to V, Maruzen, Tokyo (1977), Yoshio Ogata, *Yuki Hannoron* (*Organic Reactions*), Maruzen, Tokyo (1962), and L.F. Fieser and M. Fieser, *Advanced Organic Chemistry,* Maruzen, Tokyo (1962).

Specific examples of the pendant dye of the present invention and examples of the synthesis thereof will be set forth below, but the present invention should not be construed as being limited thereto.

PS-1
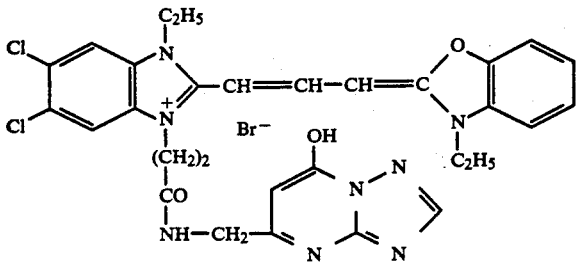
PS-2
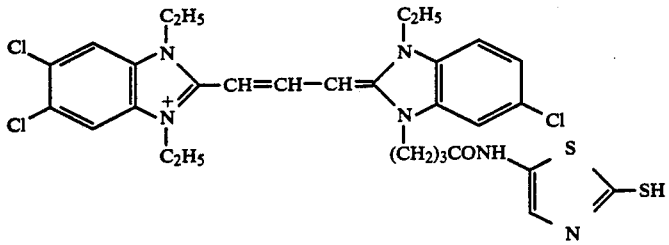
PS-3
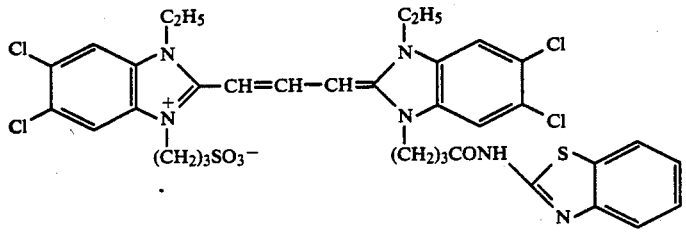
PS-4
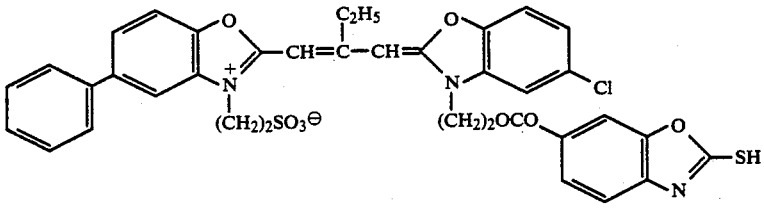
PS-5
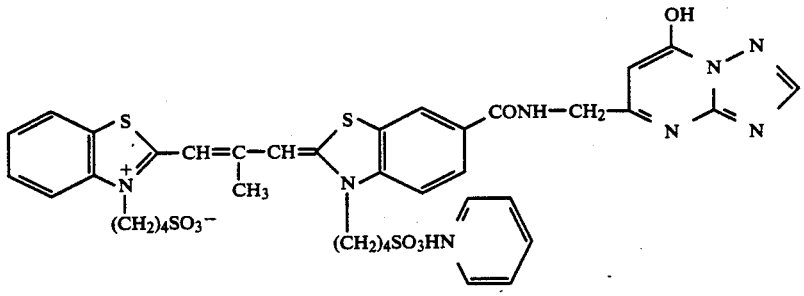
PS-6
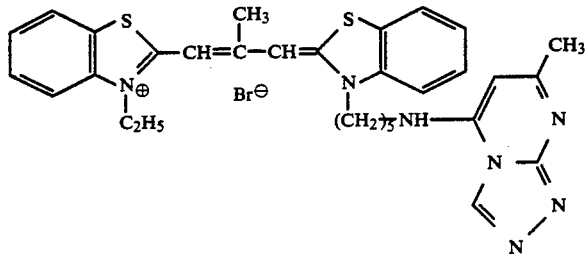

-continued
PS-7
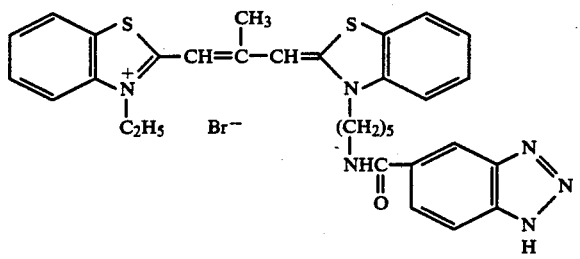
PS-8
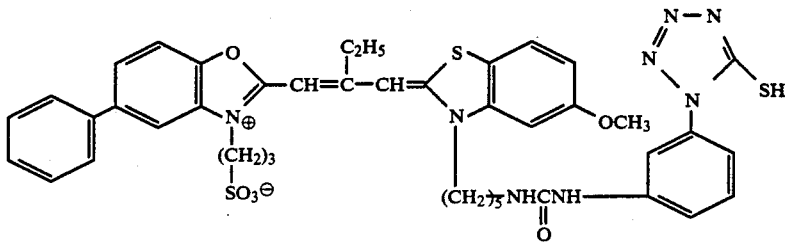
PS-9
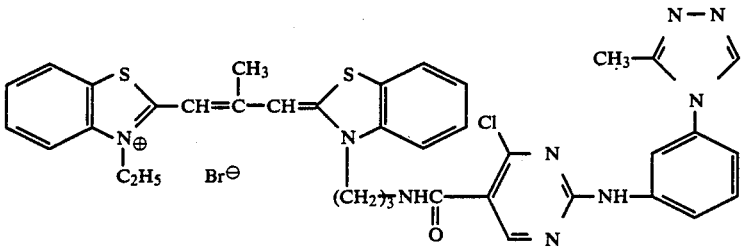
PS-10
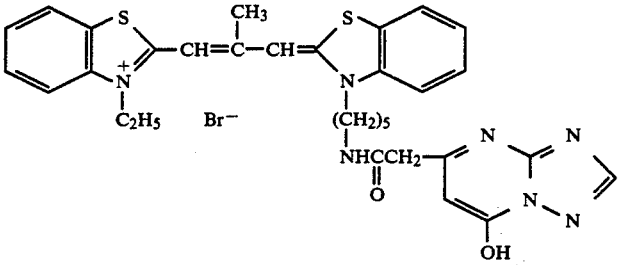
PS-11
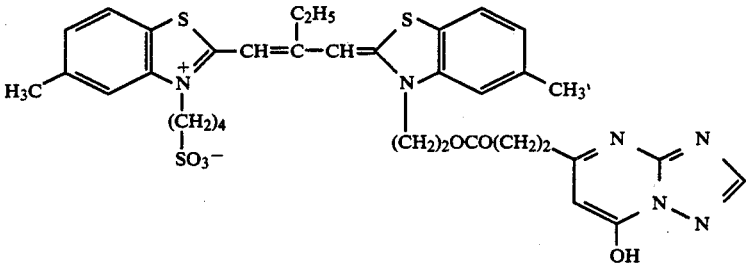
PS-12
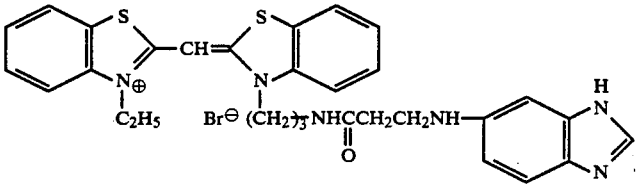

-continued
PS-13
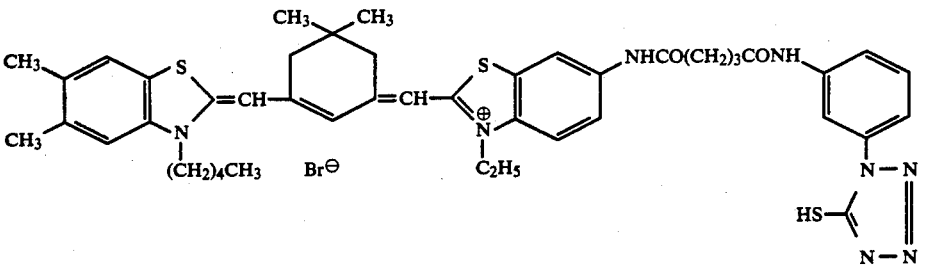
PS-14
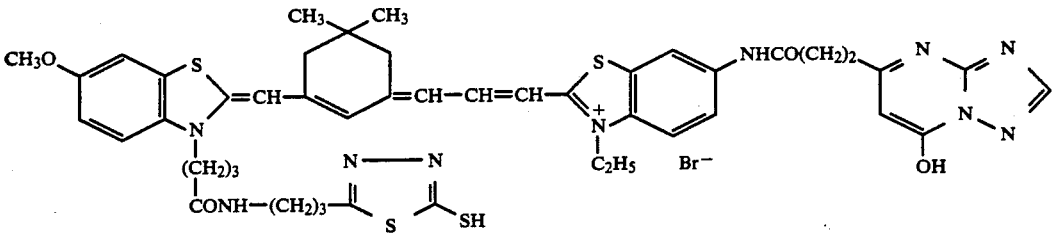
PS-15
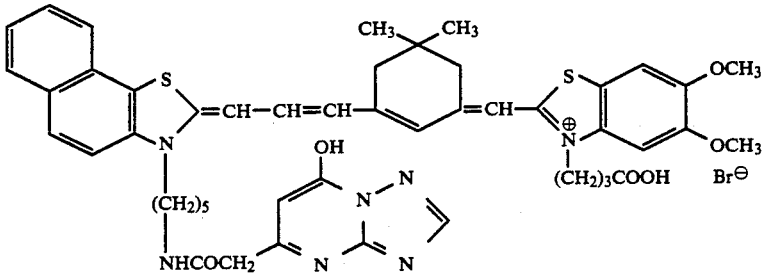
PS-16
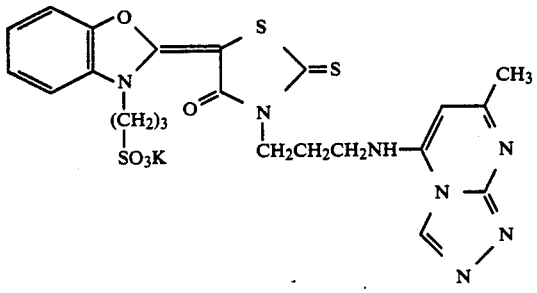
PS-17
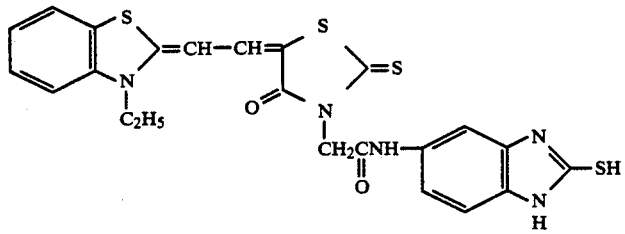
PS-18
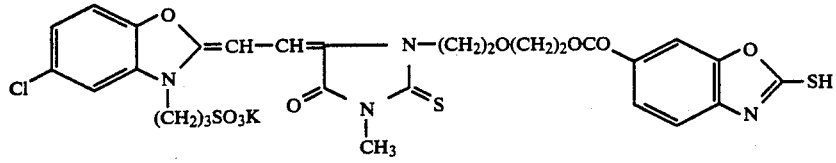

-continued
PS-19
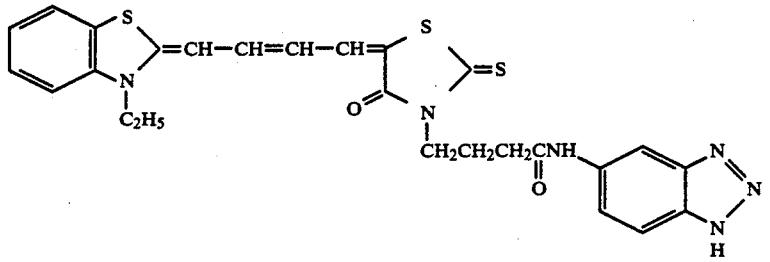
PS-20
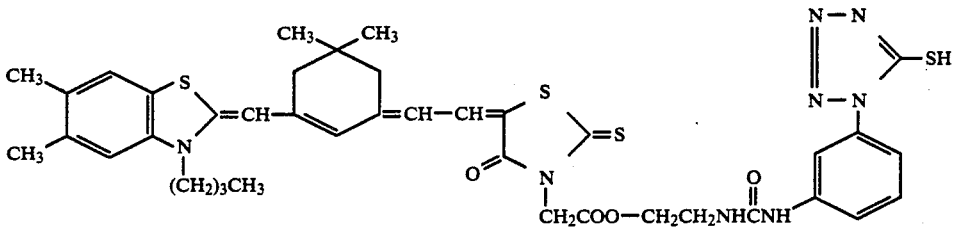
PS-21
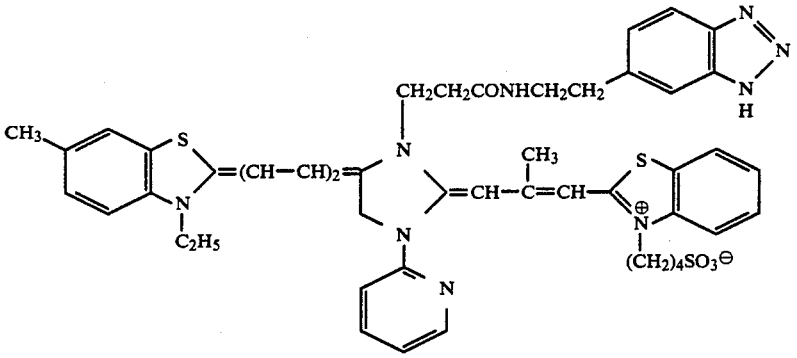
PS-22
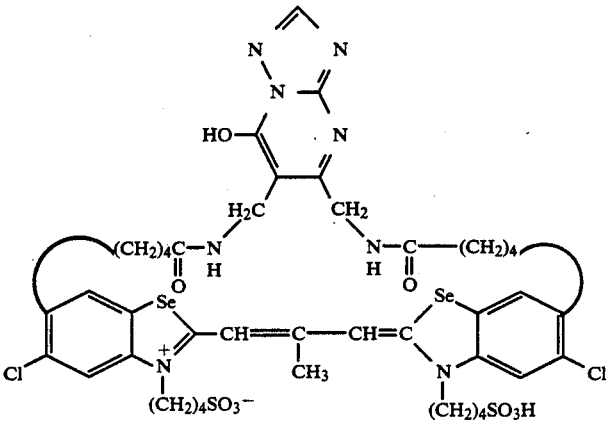

-continued
PS-23
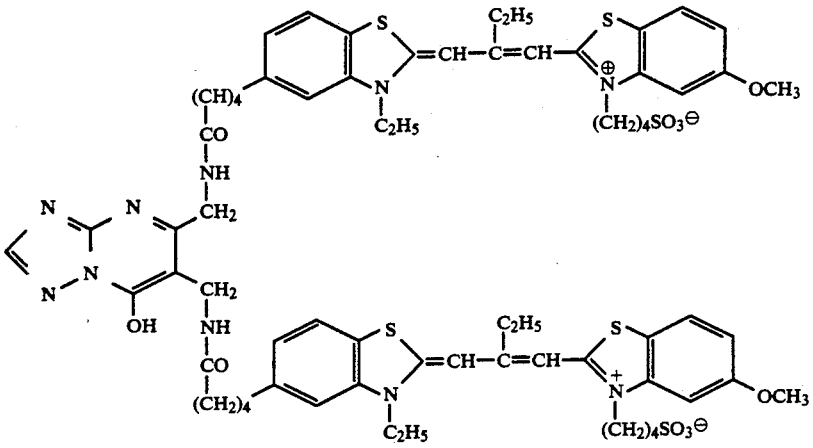
PS-24
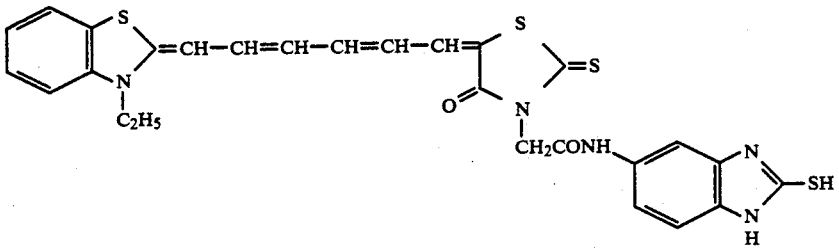
PS-25
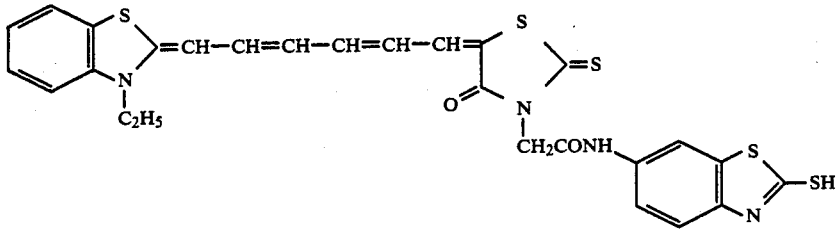
PS-26
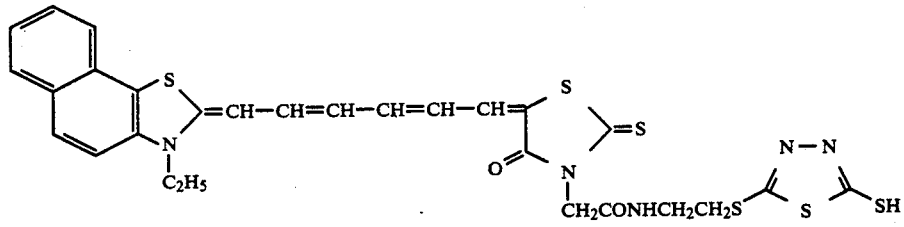
PS-27
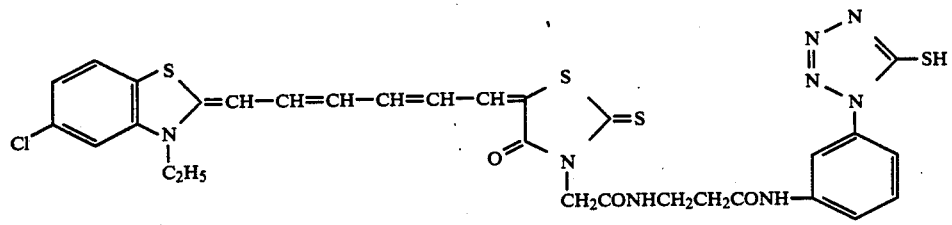
PS-28
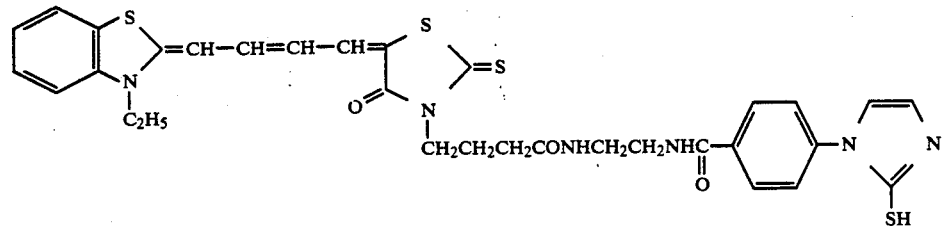

-continued
PS-29
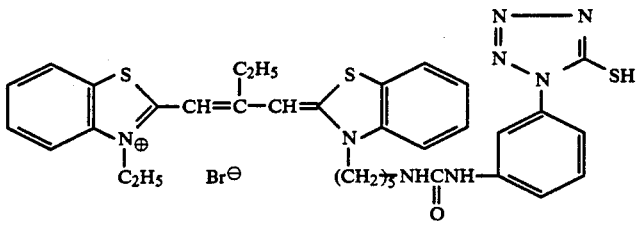
PS-30
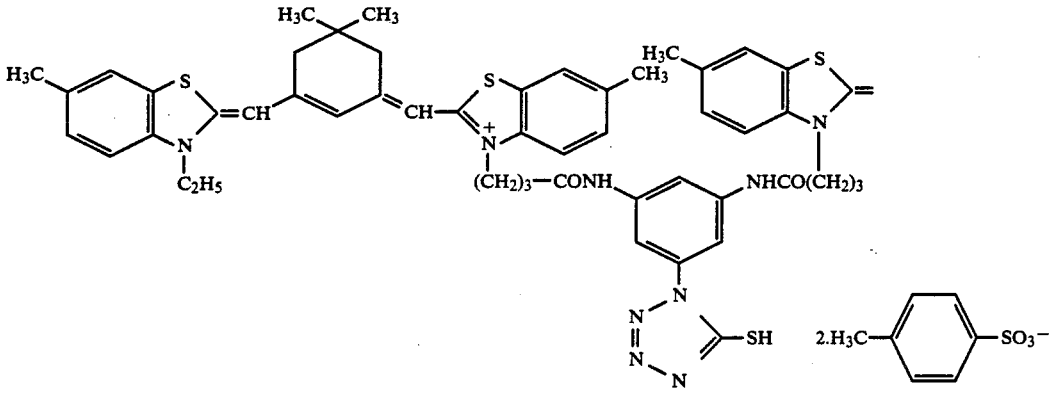
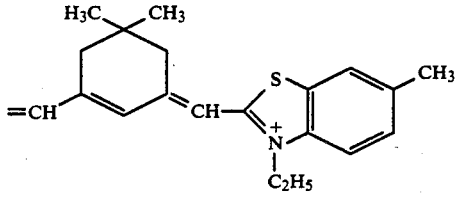
PS-31
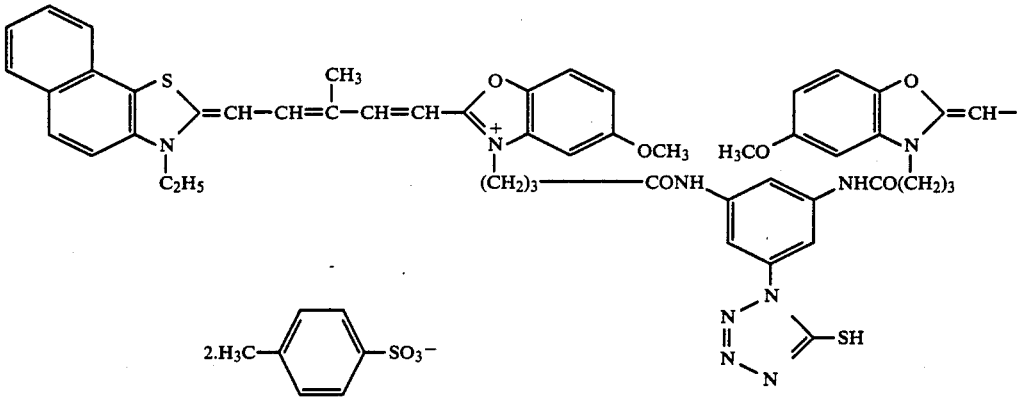
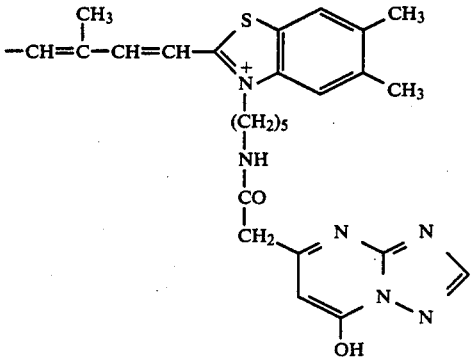

-continued

PS-32

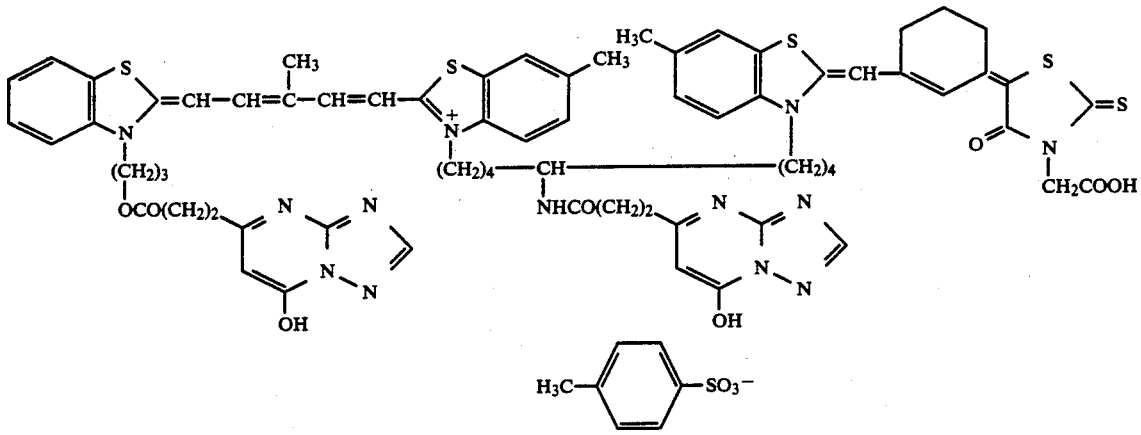

SYNTHESIS EXAMPLE 1

Synthesis of Dye PS-6

Two hundred mg of 3-(5-aminopentyl)-3'-ethyl-9-methylthiacarbocyanine bromide hydrobromide was added to 50 ml of methanol. 0.15 ml of triethylamine was then added to the mixture. The mixture was stirred at room temperature. After 5 minutes, 100 mg of 4-chloro-6-methyl-1,3,3a, 7-tetraazaindene was added to the mixture. This mixture was allowed to react at room temperature for 2 hours and then at a temperature of 60° C. for 4 hours. The reaction mixture was then subjected to silica gel column chromatography (eluting solution: methanol/chloroform $=\frac{1}{3}$) to obtain 80 mg of the desired dye (PS-6). (Dark blue crystal; m.p. 250° C. or higher)

$\lambda_{max}^{methanol}$:544 nm

FAB-MS (posi) m/1=568 (M-Br)+

SYNTHESIS EXAMPLE 2

Synthesis of Dye PS-7

One hundred ninety mg of 3-(5-aminopentyl)-3'-ethyl-9-methylthiacarbocyanine bromide hydrobromide was added to 60 ml of acetonitrile. 0.15 ml of triethylamine was added to the mixture. The mixture was stirred at room temperature. After 10 minutes, 160 mg of 5-phenoxycarbonyl benzotriazole was added to the mixture. The reaction mixture was allowed to react at a temperature of 60° C. for 1 day.

The reaction mixture was then subjected to silica gel column chromatography (eluting solution: methanol/chloroform $=\frac{1}{3}$) to obtain 19 mg of the desired dye. (Dark purplish red crystal; m.p. 250° C. or higher)

$\lambda_{max}^{methanol}$:544 nm

FAB-MS (posi) m/1=581 (M-Br)+

SYNTHESIS EXAMPLE 3

Synthesis of Dye PS-10

Two hundred g of 3-(5-aminopentyl)-3'-ethyl-9-methylthiacarbocyanine bromide hydrobromide was added to a mixture of 100 ml of acetonitrile and 50 ml of chloroform. 0.15 ml of triethylamine was then added to the mixture. The mixture was then stirred at room temperature. After 10 minutes, 200 mg of 6-(4-chlorophenoxycarbonylmethyl)-4-hydroxy-1, 3,3a,7-tetraazaindene was added to the mixture. This mixture was then allowed to react at a temperature of 60° C. for 10 hours.

The reaction mixture was then subjected to silica gel column chromatography (eluting solution: methanol/chloroform $=\frac{1}{3}$) to obtain 153 mg of the desired dye. (Dark purplish red crystal; m.p. 250° C. or higher)

$\lambda_{max}^{methanol}$:546 nm

FAB-MS (posi) m/1=612 (M-Br)+

SYNTHESIS EXAMPLE 4

Synthesis of Dye PS-29

Two hundred mg of 3-(5-aminopentyl)-3',9-diethylthiacarbocyanine bromide hydrobromide was added to a mixture of 50 ml of acetonitrile and 50 ml of chloroform. 0.10 ml of triethylamine was added to the mixture. The mixture was then stirred at room temperature for 10 minutes.

One hundred sixty mg of 1-(3-phenoxycarbonylaminophenyl)-5-mercaptotetrazole was added to the mixture. This mixture was allowed to react at a temperature of 60° C. for over 8 hours.

The reaction mixture was then allowed to cool to room temperature. The resulting crystal was filtered off, and washed with methanol to obtain 50 mg of the desired dye. (Dark purplish red crystal; m.p. 250° C. or higher)

$\lambda_{max}^{methanol}$:544 nm

FAB-MS (posi) m/1=669 (M-Br)+

SYNTHESIS EXAMPLE 5

Synthesis of Dye PS-17

(i) Synthesis of 3-[N-(2-mercaptobenzimidazole-5-yl)carbamoyl]rhodanine 1.15 g of 3-carboxymethyl rhodanine and 1 g of 5-amino-2-mercaptobenzimidazole were dissolved in 25 ml of tetrahydrofuran. A solution of 1.2 g of dicyclohexyl carbodiimide in 5 ml of tetrahydrofuran was added to the solution. The mixture was then stirred at room temperature for 5 hours. The resulting precipitate was filtered off to obtain 2 g of semiopaque powder. 20 ml of N,N-dimethylformamide was added to the powder. The mixture was then stirred. Insoluble matters were filtered out. 200 ml of water was added to the filtrate. The resulting precipitate was filtered off, washed with water and then dried to obtain 1.1 g of 3-[N-(2-mercaptobenzimidazole-5-yl)carbamoyl]rhodanine in the form of semiopaque powder;

(ii) Synthesis of Dye PS-17

Two hundred fifty ml of methanol and 1 ml of triethylamine were added to 1 g of the rhodanine compound obtained at Process (i) and 1.3 g of 2-[2-(N-acetyl-N-phenylamino)vinyl]-3-ethylbenzothiazolium iodide. The mixture was then refluxed for 180 minutes. The reaction solution was cooled. The resulting precipitate was filtered off, and then washed with methanol to obtain 1.6 g of a crude dye. 10 ml of N,N-dimethylformamide was added to the crude dye. The mixture was then stirred. Insoluble matters were filtered out. 90 ml of methanol was added to the filtrate. The resulting precipitate was filtered off, and then washed with methanol. The dye thus obtained was then dissolved in N,N-dimethylformamide. Methanol was added to the solution to effect precipitation. The resulting precipitate was washed with methanol, and then dried to obtain 120 mg of Dye PS-17 (black crystal; m.p. 250° C. or higher).

$\lambda_{max}^{methanol}$:525 nm

SYNTHESIS EXAMPLE 6

Synthesis of Dye PS-24

Two hundred fifty ml of methanol and 1 ml of triethylamine were added to 1 g of the rhodanine compound obtained by Process (i) in Synthesis Example 5 and 1.45 g of 2-[6-(N-acetyl-N-phenylamino)-1,3,5-hexatrienyl)-3-ethylbenzothiazolium iodide. The mixture was then refluxed for 180 minutes. The reaction solution was cooled. The resulting precipitate was filtered off, and then washed with methanol to obtain 2 g of a crude dye. 10 ml of N,N-dimethylformamide was added to the crude dye. The mixture was stirred. Insoluble matters were then filtered out. 90 ml of methanol was added to the filtrate. The resulting precipitate was filtered off, and then washed with methanol. This process was further repeated twice to obtain 40 mg of PS-24. (Black crystal; m.p. 250° C. or higher)

$\lambda_{max}^{methanol}$:630 nm

SYNTHESIS EXAMPLE 7

Synthesis of Dye PS-25

Synthesis of 3-[N-(2-mercaptobenzothiazole-6-yl)carbamoyl]rhodanine

Two hundred ml of tetrahydrofuran was added to 1.8 g of 6-amino-2-mercaptobenzothiazole. Insoluble matters were then filtered out. 1.9 g of 3-carboxymethylrhodanine was dissolved in the filtrate.

2 g of N,N-dicyclohexylcarbodiimide was added to the solution. The mixture was then stirred at room temperature for 7 hours. The resulting insoluble matters were filtered out. The filtrate was then concentrated under reduced pressure. Ethyl acetate was then added to the material. The mixture was refluxed. The resulting crystal was then filtered off to obtain 2.1 g of 3-[N-(2-mercaptobenzothiazole-6-yl)carbamoyl]rhodanine;

(ii) Synthesis of PS-25

One hundred fifty ml of methanol and 0.4 ml of triethylamine were added to 0.5 g of the rhodanine compound obtained in Process (i) and 0.69 g of 2-[6-(N-acetyl-N-phenylamino)-1, 3,5-hexatrienyl]-3-ethylbenzothiazolium iodide. The mixture was then refluxed under heating for 1 hour. The reaction solution was allowed to cool. The resulting precipitate was filtered off, and then washed with methanol to obtain a crude dye. The crude dye was then dissolved in N,N-dimethylformamide. The solution was diluted with methanol to effect precipitation. This process was repeated for purification. The material was then purified through silica gel column chromatography (eluting solution: ethyl acetate/chloroform=9/1) to obtain 25 mg of PS-25 in the form of dark blue crystal (m.p. 250° C. or higher).

$\lambda_{max}^{methanol}$:630 nm

The pendant dye of the present invention may be incorporated in the silver halide photographic emulsion of the present invention at any time after the beginning of the formation of grains to be incorporated in the silver halide photographic emulsion and before the completion of the chemical ripening of the silver halide photographic emulsion. As described in J.E. Maskasky, *J. Imag. Sci.*, 30, pp. 247–254 (1986), JP-A-62-123447, JP-A-62-124551, JP-A-62-123446 and JP-A-62-124552 and U.S. Pat. Nos. 2,735,766 and 3,628,960, it has been known that when silver halide grains are formed in the presence of various sensitizing dyes, fog inhibitors and analogous compounds, grains are deformed.

Such a phenomenon may also occur when a pendant dye of the present invention is incorporated during the formation of silver halide grains. If it is not desired to cause deformation of silver halide grains, the incorporation of the pendant dye may be effected at any time before the completion of the chemical ripening process. In order to obtain a higher sensitivity/fog ratio, the incorporation of the pendant dye may be preferably effected at any time after the completion of the formation of silver halide grains and before the second half of the chemical ripening process.

The optimum amount of the pendant dye to be incorporated in the present silver halide photographic emulsion depends on the shape and size of silver halide grains to be formed and is normally in the range of $1\times10^{-6}$ to $5\times10^{-3}$ mol, preferably $1\times10^{-5}$ to $2.5\times10^{-3}$ mol per mol of silver halide.

The pendant dye of the present invention can be directly dispersed in the present silver halide emulsion or incorporated in the present silver halide emulsion in the form of a solution in a solvent such as water, acetone, methanol, ethanol, propanol, tetrahydrofuran, methyl cellosolve, 2,2,3,3-tetrafluoropropanol and N,N,-dimethylformamide or a mixture thereof.

Ultrasonic wave can be used to facilitate dissolution. The incorporation of the pendant dye can be accomplished by any suitable method such as: (1) the method described in U.S. Pat. No. 3,469,987 which comprises dissolving a dye in a volatile organic solvent, dispersing the solution in water or a hydrophilic colloid, and then adding the dispersion to an emulsion; (2) the method described in JP-B-46-24185 which comprises dispersing a water-insoluble dye in a water-soluble solvent without dissolving it, and then adding the dispersion to an emulsion; (3) the method described in JP-B-44-23389, JP-B-44-27555 and JP-B-57-22091 which comprises dissolving a dye in an acid, and then adding the solution to an emulsion or preparing an aqueous solution of a dye containing an acid or base present therewith, and then adding the solution to an emulsion; (4) the method described in U.S. Pat. Nos. 3,822,135 and 4,006,025 which comprises preparing an aqueous solution or colloid dispersion of a dye containing a surface active agent present therewith, and then adding the solution or dispersion to an emulsion; (5) the method described in JP-A-53-102733 and JP-A-58-105141 which comprises directly dispersing a dye in a hydrophilic colloid, and then adding the dispersion to an emulsion; and (6) the method described in JP-A-51-74624 which comprises dissolving a dye with a compound which causes a red shift, and then adding the solution to an emulsion.

In the present invention, a single pendant dye can be incorporated in the silver halide photographic emulsion or a plurality of pendant dyes can be optionally incorporated in the silver halide photographic emulsion depending on the intended purpose. The present pendant dyes can be used in combination with other commonly used sensitizing dyes (e.g., compounds represented by the general formula (I)) and/or commonly used known fog inhibitors (e.g., compounds represented by the general formula (II)) and/or known supersensitizers. In this case, if at least one of these pendant dyes is incorporated in the emulsion before the completion of the chemical ripening process, the incorporation of the other compounds may be effected at any time before the coating of the silver halide emulsion. If the sensitizing dye to be used in combination easily causes fogging, the incorporation of the other compounds is preferably effected after the incorporation of the present pendant dye to inhibit fogging.

Examples of supersensitizers which can be used in the present invention include bispyridinium salts described in JP-A-59-142541, aminostilbene derivatives described in JP-B-59-18691 and JP-A-63-239449, water-soluble bromides and water-soluble iodides disclosed in JP-B-49-46932, condensation products of aromatic compounds and formaldehyde described in U.S. Pat. No. 3,743,510, and cadmium salts.

If the present pendant dye is used in combination with other pendant dyes or the above mentioned sensitizing dyes, fog inhibitors and supersensitizers, their mixing ratio can be properly selected depending on the intended purpose. In the former case, the mixing ratio is preferably in the range of 1/10 to 10/1. If the pendant dye is used in combination with a sensitizing dye in the latter case, the mixing ratio is preferably in the range of 1/10 to 5/1. If the pendant dye is used in combination with a fog inhibitor and/or supersensitizer, the mixing ratio is preferably in the range of 0.1 to 50 equivalents per equivalent of the pendant dye.

The silver halide emulsion to be used in the present invention is normally prepared by mixing a water-soluble silver salt (e.g., silver nitrate) and a water-soluble halide (e.g., potassium bromide) in the presence of a solution of a water-soluble high molecular compound such as gelatin.

The halogen composition, shape and size of grains to be contained in the present AgX emulsion are not specifically limited. Known AgX emulsion grains having any halogen composition, shape and size can be used.

As the halogen composition of the silver halide grain there can be used silver chloride or silver bromide as well as mixed silver halide such as silver bromochloride, silver bromoiodide and silver bromochloroiodide. Halogen grains having a high surface Cl content adsorb a cyanine dye weakly but adsorb a fog inhibitor strongly and are much likely to exhibit the above described undesirable effects. Therefore, AgX grains having a surface Cl content of 50 mol % or more, preferably 80 mol % or more, more preferably 95 mol % or more exhibit the effects of the present invention, particularly in spectral sensitivity. In particular, the effects of the present invention can be accomplished more easily when the AgX grains comprise those having a $Cl^-$ content of 50 mol % or more, preferably 80 mol % or more, more preferably 95 mol % or more in a proportion of 60% or more, preferably 70% or more as calculated in terms of the total projected area or surface area.

Grains having a high surface iodine content tend to adsorb a dye strongly but adsorb a fog inhibitor weakly. Therefore, such grains may exhibit an insufficient inhibiting fog effect. In this case, the pendant dye of the present invention improves the adsorption of a fog inhibitor and inhibits fog which is easily caused by a sensitizing dye. This effect can be more easily attained when the surface iodine content of grains is in the range of 3 mol % to limit of solid solution, preferably 5 to 30 mol %.

Therefore, the sensitivity/fog ratio of the present AgX emulsion can be more easily increased when the AgX grains comprise those having an $I^-$ content of 3 mol % to limit of solid solution, preferably 5 to 30 mol % in a proportion of 60% or more, preferably 70% or more as calculated in terms of the total projected area or surface area. The grain surface as used herein goes down to the depth determined by XPS (X-ray Photoelectron Spectroscopy) surface analysis (about 10 Å).

For the principle of XPS method used for the analysis of the halogen content in and around the surface of silver halide grains, reference can be made to Junichi Aihara et al., *Denshi no Bunko* (*Spectroscopy of Electron*), Kyoritsu Library 16, Kyoritsu Shuppan, 1978.

The mean size of silver halide grains is preferably 5 μm or less as calculated in terms of grain diameter for spherical or nearly spherical grains or side length for cubic grains. The mean value is obtained by averaging the values based on projected area. The grain size distribution may be either narrow (monodisperse) or wide.

These silver halide grains may be in various crystal forms such as cube, tetradecahedron, octahedron as well as rhombic dodecahedron, triaxisoctahedron, icositetrahedron, tetraxisshexahedron, and octahexahedron. For details of these grains, reference can be made to E. Moisar and E. Klein, *Ber. Bunsenges. Phy. Chem.*, 67, 949 (1963), 63, 356–359, R.W. Beriman, *J. Photogr. Sci.*, 12, 121 (1964), K. Murofushi et al., *International Congress of Photographic Science*, Tokyo (1967), J.E. Maskasky, *J. Imag. Sci.*, 30, 247–254 (1986), JP-A-62-42148, JP-A-62-123446, JP-A-62-123447, JP-A-62-124550, JP-A-62-124551, JP-A-62-124552, JP-A-63-25643, JP-A-63-27831 and JP-A-63-41845, JP-B-55-42737, Kokai Giho 86-9598, European Patent 171238 and JP-A-2-000032.

As mixed crystal AgX grains there can also be preferably used those having a uniform composition as described in JP-A-1-284848 and Japanese Patent Application No. 63-162144.

Furthermore, silver halide grains having the above described crystal forms but substantially free of twinning plane or silver halide grains which are monodisperse in grain size distribution can be used. For details, reference can be made to Japanese Patent Application No. 63-84664.

Moreover, silver halide grains having the conventional tabular grain form of tabular silver halide grains having a hexagonal or circular main plane which are monodisperse in grain size distribution can be used. For details, reference can be made to JP-A-58-113926, JP-A-58-113927, JP-A-58-113928, JP-A-58-108525, JP-A-61-6643, JP-A-52-153428 and JP-A-63-151618, E.P. 0227444, U.S. Pat. No. 4,713,320, JP-A-2-000838 and Japanese Patent Application No. 62-203635.

From the standpoint of improvement in spectral sensitivity, grains having a greater specific surface area are preferably used. In this respect, tabular grains are preferably used. In this case, tabular silver halide grains having an aspect ratio of 2 or more, preferably 4 to 20 are preferably used. Therefore, an emulsion comprising such tabular silver halide grains in a proportion of 50% or more based on total projected area thereof is preferably used.

The term "aspect ratio" as used herein means a ratio of diameter to thickness of tabular grain. The grain diameter is the diameter of the circle having the same area as the projected area of grain as observed through a microscope or electron microscope.

For details, reference can be made to JP-A-58-127921 and JP-A-58-113927.

More preferably, the tabular silver halide grains which can be used in the present invention are monodisperse.

Because of their large specific surface area, these tabular silver halide grains can exhibit a great adsorbed dye amount per grain, accomplish the present effect of improving the spectral sensitization efficiency and accomplish the effects of monodisperse tabular grains described in JP-A-2-000838. With such tabular silver halide grains, a high sensitivity and high picture quality silver halide photographic material can be advantageously obtained. In this case, the monodisperse tabular grains are tabular silver halide grains comprising those having two twinning planes parallel with the main plane in a proportion of 70% or more, preferably 90% or more, more preferably 95% or more based on the total projected area thereof, a grain size distribution variation coefficient (C.V.) of 30% or less, preferably 20% or less, more preferably 15% or less and an aspect ratio of 2 or more, preferably 4 to 20.

The silver halide grains of the present invention can be uniform or different from internal to surface in halogen composition or have a layer structure. The change in halogen composition between layers may be progressively increase or decrease or be steep depending on the intended purpose.

Furthermore, other known silver halide grains such as epitaxial grains comprising a host portion and an epitaxial growth portion, ruffled grains, grains having a rearrangement line can be used in the present invention. For details, reference can be made to JP-A-2-000838 and Japanese Patent Application No. 63-223739. The silver halide grains of the present invention may be of the type wherein latent images are mainly formed on the surface thereof or the type wherein latent images are formed mainly in the interior thereof.

The photographic emulsion to be used in the present invention can be prepared according to the processes described in P. Glafkides, *Chimie et Physique Photographique,* Paul Montel (1967), G.F. Duffin, *Photographic Emulsion Chemistry,* Focal Press (1966), and V.L. Zelikman et al., *Making and Coating Photographic Emulsion,* Focal Press (1964).

The emulsion can be prepared by any of the acid process, the neutral process, the ammonia process, etc. The reaction of soluble silver salts and soluble halides can be carried out by a single jet process, a double jet process, a combination thereof, or the like. A method in which grains are formed in the presence of excess silver ions (so-called reverse mixing method) may be used. Further, a so-called controlled double jet process, in which a pAg value of a liquid phase in which silver halide grains are formed is maintained constant, may also be used. According to the controlled double jet process, a silver halide emulsion having a regular crystal form and an almost uniform grain size can be obtained.

During silver halide grain formation or physical ripening, a cadmium salt, a zinc salt, a lead salt, a thallium salt, an iridium salt or a complex thereof, a rhodium salt or a complex thereof, or an iron salt or a complex thereof may be present in the system.

During the formation of silver halide grains, the growth of the grains can be controlled by the use of a silver halide solvent such as ammonia, potassium thiocyanate, ammonium thiocyanate, a thioether compound, the thione compound described in JP-A-53-144319, JP-A-53-82408 and JP-A-55-77737, and the amine compound described in JP-A-54-400717.

The silver halide emulsion of the present invention can be used without being chemically sensitized, i.e., as an unripened emulsion (primitive emulsion) but is preferably subjected to chemical sensitization.

The silver halide emulsion of the present invention is normally subjected to chemical sensitization.

The chemical sensitization of the silver halide emulsion can be accomplished by any suitable methods as described in H. Frieser, *Die Grundlaqen der Photographischen Prozesse mit Silberhalogeniden,* Akademische Verlagsgesellschaft, 1968, p. 675–734.

In particular, (1) a sulfur sensitization process using a sulfur-containing compound capable of reacting with active gelatin or silver (e.g., thiosulfate, thiourea, mercapto compound, rhodanine), (2) a reduction sensitization process using a reducing substance (e.g., stannous salt, amine, hydrazine derivative, formamidinesulfinic acid, silane compound), or (3) a noble metal sensitization process using a noble metal compound (e.g., gold complex, complex of the group VIII metals such as Pt, Ir, Pd) may be used, singly or in combination.

Other examples of suitable sensitizers include polyoxyethylene derivatives described in British Patent 981,470, JP-B-31-6475, and U.S. Pat. No. 2,716,062, polyoxypropylene derivatives and quaternary ammonium groups.

The photographic emulsion to be used in the present invention may contain various compounds for the purpose of inhibiting fog during the preparation, preservation or photographic processing of the light-sensitive material or stabilizing the photographic properties thereof. Examples of such compounds which may be incorporated in the photographic emulsion include many compounds known as fog inhibitor or stabilizer, such as azoles (e.g., benzothiazolium salt, nitroimidazoles, nitrobenzimidazoles, chlorobenzimidazoles, bromobenzimidazoles, nitroindazoles, benzotriazoles, and aminotriazoles), mercapto compounds (e.g., mercaptothiazoles, mercaptobenzothiazoles, mercaptobenzimidazoles, mercaptothiadiazoles, mercaptobenzimidazoles, mercaptotetrazoles (particularly 1-phenyl-5-mercaptotetrazole), mercaptopyrimidines, mercaptotriazines), thioketo compounds (e.g., oxazolinethione), azaindenes (e.g., triazaindenes, tetraazaindenes (particularly 4-hydroxy-substitute (1,3,3a,7)tetraazaindenes), pentaazaindenes), benzenesulfonic acid, benzenesulfinic acid, and benzenesulfonamide.

For further specific examples of these compounds and their usage, reference can be made to U.S. Pat. Nos. 3,954,474 and 3,982,947 and JP-B-52-28660.

As a binder or protective colloid to be incorporated in the light-sensitive material together with a spectrally sensitized silver halide emulsion of the present invention there can be advantageously used gelatin. Besides gelatin, hydrophilic high molecular compounds can be used. Examples of such gelatin include lime-treated gelatin, acid-treated gelatin and derivative gelatin. For details, reference can be made to *Research Disclosure,* Vol. 176, No. 17643 (December, 1978), Article IX.

The spectrally sensitized silver halide emulsion of the present invention and photographic materials comprising an emulsion may comprise a dye-forming coupler, i.e., a compound which can undergo oxidation coupling with an aromatic primary amine developing agent (e.g., phenylenediamine derivative, aminophenol derivative) upon color development to develop color. As such a coupler there is preferably used a nondiffusible coupler containing a hydrophobic group called a ballast group in the molecule or polymerized coupler. The coupler may be either 2-equivalent or 4-equivalent to silver ion. The present silver halide emulsion or photographic material may also comprise a colored coupler having the effect of color correction, a coupler which releases a development inhibitor with development (so-called DIR coupler) or a coupler which releases a development accelerator or fogging agent with development (so-called DAR coupler or FR coupler). The present silver halide emulsion or photographic materials may further comprise a colorless compound-forming DIR coupling compound which undergoes a coupling reaction to give a colorless product and release a development inhibitor.

Examples of magenta couplers include: a 5-pyrazolone coupler, a pyrazolobenzimidazole coupler, a cyanoacetylcoumarone coupler, an open chain acylacetonitrile coupler, and a pyrazoloazole coupler. Examples of yellow couplers include an acylacetamide coupler (e.g., benzoylacetanilides, pivaloylacetanilides). Examples of cyan couplers include a naphthol coupler and a phenol coupler.

In order to satisfy the properties required for the light-sensitive material, two or more of these couplers may be incorporated in the same layer or one of these couplers may be incorporated in two or more different layers.

In addition to the above compounds, desensitizers, brightening agents, high boiling organic solvents (coupler solvents), dye image stabilizers, stain inhibitors, absorbers (dyes, light absorbers, UV absorbers), film hardeners, coating aids (surface active agents), plasticizers, lubricants, antistatic agents, matting agents, and development accelerators can be incorporated in the silver halide emulsion and photographic materials to be used in the present invention. As the above described additives there can be used those described in *Research Disclosure,* Vol. 176, No. 17643 (December, 1978), Articles I–XVI (pp. 22–28).

The finished emulsion is coated on a proper support, such as baryta paper, resin-coated paper, synthetic paper, triacetate film, polyethylene terephthalate film or any other plastic base or glass plate. In particular, the coating of the finished emulsion can be accomplished by any suitable coating method such as dip coating, air knife coating, curtain coating and extrusion coating using hopper described in U.S. Pat. No. 2,681,294.

Transparent or opaque supports are selected depending on the purpose of the light-sensitive material. Transparent supports can be colored transparent with a dye or pigment as well as colorless transparent.

In order to obtain photographic images, the exposure of the light-sensitive material can be accomplished by any commonly used method. In particular, various known light sources such as natural light (sunshine), tungsten light, fluorescent tube, mercury vapor lamp, xenon arc lamp, carbon arc lamp, xenon flash lamp, cathode ray tube, and flying spot. It goes without saying that the exposure time ranges from 1/1,000 second to 1 second, the range commonly used in cameras. In the present invention, the exposure time may be shorter than 1/1,000 second, e.g., $1/10^4$ to $1/10^6$ second given by a xenon flash lamp or cathode ray tube or longer than 1 second. The spectral composition of light to be used for exposure can be adjusted with a color filter as necessary. LED or gas laser can be used for exposure. LED or gas laser can also be used to give an exposure time of $1/10^6$ or less. Light modified by an SHG element can be used. The exposure can also be accomplished by light emitted from a fluorescent material which has been excited by electronic ray, X-ray, $\gamma$-ray or $\alpha$-ray.

Examples of photographic light-sensitive materials which can comprise the present photographic emulsion include various color and black-and-white light-sensitive materials. Specific examples of these light-sensitive materials include: color negative films for photographing (for general use, motion picture, etc.), color reversal films (for slide, motion picture, etc.; optionally comprising or free of a coupler), color photographic papers, color positive films (for motion picture, etc.), color reversal photographic papers, heat developable color light-sensitive materials, color light-sensitive materials utilizing silver dye bleaching process, photographic light-sensitive materials for plate making (lithographic film, scanner film, etc.), X-ray photographic light-sensitive materials (for direct and indirect medical use, industrial use, etc.), black-and-white negative films for photographing, black-and-white photographic papers, microphotographic light-sensitive materials (for COM use, microfilm, etc.), color dispersion transfer process light-sensitive materials (DTR), silver salt dispersion transfer process light-sensitive materials, light-sensitive materials for printout, and heat developable color light-sensitive materials.

The photographic processing of light-sensitive materials comprising the present silver halide emulsion can be accomplished by any suitable known black-and-white or color development process. As processing solutions there can be used known processing solutions.

Color developers to be used for development processing of light-sensitive materials according to the present invention preferably include alkaline aqueous solutions containing as a main component an aromatic primary amine developing agent. Usable color developing agents include aminophenol compounds, and preferably p-phenylenediamine compounds. Typical examples of the latter are 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline, and sulfates, hydrochlorides or p-toluenesulfonates thereof. These compounds may be used in combination of two or more thereof according to the purpose.

The color developer generally contains pH buffers, such as carbonates, borates or phosphates of alkali metals, and developing inhibitors or antifoggants, such as bromides, iodides, benzimidazoles, benzothiazoles and mercapto compounds. If desired, the color developer may further contain various preservatives (e.g., hydroxylamines, diethylhydroxylamine, hydrazine sulfites, phenylsemicarbazides, triethanolamine, catecholsulfonic acids, and triethylenediamine (1,4-diazabicyclo[2,2,2]-octane); organic solvents (e.g., ethylene glycol and diethylene glycol); development accelerators (e.g., benzyl alcohol, polyethylene glycol, quaternary ammonium salts, and amines); color-forming couplers, competing couplers; fogging agents (e.g., sodium boron hydride); auxiliary developing agents (e.g., 1-phenyl-3-pyrazolidone); viscosity increasing agents; various chelating agents (exemplified by aminopolycarboxylic acids, aminopolyphosphoric acids, alkylphosphonic acids, and phosphonocarboxylic acids, e.g., ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,',N'-tetramethylenephosphonic acid, and ethylenediaminedi(o-hydroxyphenylacetic acid), and salts thereof).

Reversal processing is usually carried out by black-and-white development followed by color development. Black-and-white developers to be used can contain one or more known black-and-white developing agents, such as dihydroxybenzenes (e.g., hydroquinone), 3-pyrazolidones (e.g., 1-phenyl-3-pyrazolidone) and aminophenols (e.g., N-methyl-p-aminophenol).

The color developer or black-and-white developer usually has a pH of from 9 to 12. The replenishment rate of the developer is usually 3 liters or less per $m^2$ of the light-sensitive material, depending on the type of the color photographic material to be processed. The replenishment rate may be reduced to 500 ml/$m^2$ or less by decreasing the bromide ion concentration in the replenisher. When the replenishment rate is reduced, it is preferable to reduce the area of the liquid surface in contact with air in the processing tank to thereby prevent evaporation and air oxidation of the liquid. The replenishment rate can also be reduced by a means for suppressing accumulation of the bromide ion in the developer.

The photographic emulsion layer which has been color-developed is usually subjected to bleach. Bleaching may be performed simultaneously with fixation (i.e., blix), or these two steps may be carried out separately. For speeding up of processing, bleaching may be followed by blix. Furthermore, an embodiment wherein two blix baths are preceded by fixation, or an embodiment wherein blix is followed by bleach may be selected arbitrarily according to the purpose. Bleaching agents to be used include compounds of polyvalent metals, e.g., iron(III), cobalt(III), chromium(VI), and copper(II), peracids, quinones, nitroso compounds, and the like. Typical examples of these bleaching agents are ferricyanides; bichromates; organic complex salts of iron(III) or cobalt(III), such as complex salts with aminopolycarboxylic acids, e.g., ethylenediaminetetraacetic acid, diethylenetriaminepentaacetic acid, cyclohexanediaminetetraacetic acid, methyliminodiacetic acid, 1,3-diaminopropanetetraacetic acid, and glycol ether diaminetetraacetic acid, or citric acid, tartaric acid, malic acid, etc.; persulfates; hydrobromic acid salts; permanganates; nitrobenzenes; and so on. Of these, aminopolycarboxylic acid-iron(III) complex salts such as (ethylenediaminetetraacetato)iron(III) complex salts and persulfates are preferred to speed up processing and for conservation of the environment. In particular, the aminopolycarboxylic acid-iron(III) complex salts are useful in both a bleaching solution and a blix solution. The bleaching or blix solution containing the aminopolycarboxylic acid-iron(III) complex salts usually has a pH of from 5.5 to 8. To speed up processing, it is possible to adopt a lower pH value.

The bleaching bath, blix bath or a prebath thereof can contain, if desired, a bleaching accelerator. Examples of useful bleaching accelerators are compounds having a mercapto group or a disulfide group described in U.S. Pat. No. 3,893,858, West German Patent 1,290,812, JP-A-53-95630, *Research Disclosure,* No. 17129 (July, 1978); thiazolidine derivatives described in JP-A-50-140129; thiourea derivatives described in U.S. Pat. No. 3,706,561; iodides described in JP-A-58-16235, polyoxyethylene compounds described in West German Patent 2,748,430; polyamine compounds described in JP-B-45-8836; and bromine ions. Preferred among them are compounds having a mercapto group or a disulfide group because of their great acceleratory effects. In particular, the compounds disclosed in U.S. Pat. No. 3,893,858, West German Patent 1,290,812, and JP-A-53-95630 are preferred. The compounds disclosed in U.S. Pat. No. 4,552,834 are also preferred. These bleaching accelerators may be incorporated rated into the light-sensitive material. These bleaching accelerators are particularly effective for blix of color light-sensitive materials for photographing.

Fixing agents to be used for fixation include thiosulfates, thiocyanates, thioethers, thioureas, and a large amount of iodides. The thiosulfates are usually employed, with ammonium thiosulfate being applicable most broadly. Sulfites, bisulfites or carbonyl bisulfite adducts are suitably used as preservatives of the blix bath.

It is usual that the desilvered silver halide color photographic materials of the invention are subjected to washing and/or stabilization. The amount of water to be used in the washing step can be selected from a broad range depending on the characteristics of the light-sensitive material (for example, the kind of couplers, etc.), the end use of the light-sensitive material, the temperature of the washing water, the number of washing tanks (number of stages), the replenishment system (e.g., counter flow system or direct flow system), and other various factors. Of these factors, the relationship between the number of washing tanks and the amount of water in a multistage counter flow system can be obtained according to the method described in *Journal of the Society of Motion Picture and Television Engineers,* Vol. 64, pp. 248–253 (May, 1955).

According to the multistage counter flow system described in the above reference, although the requisite amount of water can be greatly reduced, bacteria would grow due to an increase of the retention time of water in the tank, and suspended matters of bacteria stick to the light-sensitive material. In the present invention, in order to cope with this problem, the method of reducing calcium and magnesium ion concentrations described in JP-A-62-288838 can be used very effectively. Furthermore, it is also effective to use isothiazolone compounds or thiabendazoles as described in JP-A-57-8542, chlorine type bactericides, e.g., chlorinated sodium isocyanurate, benzotriazole, and bactericides described in Hiroshi Horiguchi, *Bokin Bobaizai no Kagaku,* Eisei Gijutsu Gakkai (ed.), *Biseibutsu no Mekkin, Sakkin, Bobaigijutsu,* and Nippon Bokin Bobai Gakkai (ed.), *Bokin Bobaizai Jiten.*

The washing water has a pH of from 4 to 9, preferably from 5 to 8. The temperature of the water and the washing time can be selected from broad ranges depending on the characteristics and end use of the light-sensitive material, but usually range from 15° to 45° C. in temperature and from 20 seconds to 10 minutes in time, preferably from 25° to 40° C. in temperature and from 30 seconds to 5 minutes in time. The light-sensitive material of the invention may be directly processed with a stabilizer in place of the washing step. For the stabilization, any of the known techniques as described in JP-A-57-8543, JP-A-58-14834 and JP-A-60-220345 can be used.

The aforesaid washing step may be followed by stabilization in some cases. For example, a stabilizing bath containing formaldehyde and a surface active agent as is used in a final bath for color light-sensitive materials for photographing is appropriate. This stabilizing bath may also contain various chelating agents or bactericides.

The overflow accompanying replenishment of the washing bath and/or stabilizing bath can be reused in other steps such as desilvering.

For the purpose of simplifying and speeding up processing, the present processing bath may comprise a color developing agent. Such a color developing agent is preferably used in the form of various precursors. Examples of such precursors include indoaniline compounds described in U.S. Pat. No. 3,342,597, Schiff base type compounds described in *Research Disclosure,* Nos. 14850 and 15159, aldol compounds described in *Research Disclosure,* No. 13924, metal complexes described in U.S. Pat. No. 3,719,492, and urethane compounds described in JP-A-53-135628.

For the purpose of accelerating color development, the processing bath may comprise various 1-phenyl-3-pyrazolidones. Typical examples of such compounds are described in JP-A-56-64339, JP-A-57-144547, and JP-A-58-115438.

The various processing solutions are kept at a temperature of 10 to 50° C. The standard temperature range is from 33° C. to 38° C. However, a higher temperature range can be used to accelerate processing, thereby shortening the processing time. On the other hand, a lower temperature range can be used to improve the picture quality or the stability of the processing solutions. In order to save silver to be incorporated in the light-sensitive material, a processing utilizing cobalt intensification or hydrogen peroxide intensification described in West German Patent 2,226,770 or U.S. Pat. No. 3,674,499 can be effected.

In place of the above mentioned color developers, a color developer free of benzyl alcohol as described in International Patent Application WO 87-0534, and JP-A-63-146041, JP-A-63-146042 and JP-A-63-146043 can be used.

The present invention will be further described in the following examples, but the present invention should not be construed as being limited thereto.

EXAMPLE 1

Method 1 (Comparative Example)

One thousand ml of water, 30 g of deionized bone gelatin, 15 ml of a 50% aqueous solution of $NH_4NO_3$ and 7.5 ml of a 25% aqueous solution of $NH_3$ were charged into a container. 750 ml of a 1 N aqueous solution of $AgNO_3$ and a 1 N aqueous solution of NKBr were added to the mixture with vigorous stirring at a temperature of 50° C. in 40 minutes. During the reaction, the silver potential was kept at +50 mV with respect to an unsaturated calomel electrode.

A methanol solution of the following Sensitizing Dye (A-1) was added to the material continuously at a constant rate in an amount of $2.0\times10^{-4}$ per mol of silver over the period between 30 minutes after the addition of the aqueous solution of silver nitrate and 5 minutes after the completion of the addition of the aqueous solution of silver nitrate.

A-1

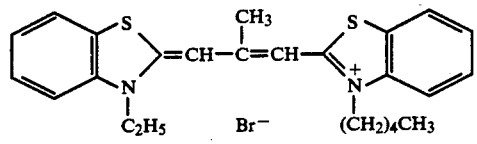

The silver bromide grains thus obtained were in the crystal form of a cube and had a side length of 0.6±0.06 μm. The emulsion was then desilvered. 140 g of deionized bone gelatin and 700 ml of water were added to the emulsion. The emulsion was then adjusted to a pH value of 6.5 and a pAg value of 8.3 at a temperature of 50° C. The emulsion was subjected to ripening with an optimum amount of sodium thiosulfate at a temperature of 50° C. for 50 minutes for sulfur sensitization (Emulsion 1).

Method 2 (Comparative Example)

Silver bromide grains were prepared and sulfur-sensitized in the same manner as in Method 1 except that there was used a methanol solution obtained by adding the following Fog Inhibitor A-2 to the methanol solution of Sensitizing Dye A-1 in the equimolecular amount (Emulsion 2).

A-2

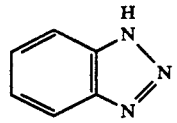

Method 3 (Present Invention)

Silver bromide grains were prepared and sulfur-sensitized in the same manner as in Method 1 except that during the formation of silver halide grains there was used Pendant Dye (PS-7) in the equimolecular amount instead of Sensitizing Dye (A-1) (Emulsion 3).

Sodium 2-(N-methylstearoylamino)ethylsulfonate, sodium dodecylbenzenesulfonate and 1,3-bis(vinyl-sulfonyl)-2-propanol were added to each of the three emulsions thereby obtained in amounts of 0.011 g/m², 0.005 g/m² and 0.274 g/m², respectively. These emulsions were each coated on a cellulose triacetate film base in an amount such that the amount of AgBr reached 7 g/m². The emulsion coats thus obtained were each exposed to light from a tungsten lamp (color temperature: 5,400° K.) through a combination of an interference filter which transmits light of 400 nm and a continuous wedge and a combination of a sharp cut filter which transmits light of a wavelength longer than 520 nm (Fuji Photo Film Co., Ltd.'s Sharp Cut Filter 52) and a continuous wedge for 1 second.

After being exposed, the film specimens were then developed with a developing solution of the following composition at a temperature of 20° C. for 4 minutes. The film specimens thus processed were then measured for density by means of a densitometer (Fuji Photo Film). The film specimens were also measured for sensitivity through a 400 nm interference filter (SB) and sensitivity and fog through a filter which transmits light of a wavelength longer than 520 nm (SY).

After being stored at a relative humidity of 80% and a temperature of 50° C., the emulsion coats were then subjected to exposure, development and measurement for density in the same manner as described above. The reference point of the optical density at which the sensitivity was determined was [fog+0.2].

Composition of Developer

| | |
|---|---|
| Water | 700 ml |
| Methol | 3.1 g |
| Sodium Sulfite Anhydride | 45 g |
| Hydroquinone | 12 g |
| Sodium Carbonate (monohydrate) | 79 g |
| Potassium Bromide | 1.9 g |
| Water to make | 1 liter |

This composition was diluted with two volumes of water before use.

The results are set forth as relative values in Table 1.

TABLE 1

| Experiment No. | Emulsion | SB | SV | Fog | After Being Stored 80% RH, 50° C., 3 Days SY* | Fog |
|---|---|---|---|---|---|---|
| 1 (Comparison) | 1 | 100 (reference) | 100 (reference) | 0.08 | 95 | 0.12 |
| 2 (Comparison) | 2 | 115 | 115 | 0.09 | 76 | 0.12 |
| 3 (Invention) | 3 | 91 | 105 | 0.02 | 100 | 0.02 |

*Value relative to SY of specimens which were not stored under these conditions, which is taken as 100.

Table 1 shows that the method of the present invention is excellent. In particular, Experiment No. 1 wherein a sensitizing dye was simply used provides a higher sensitivity than the cases where the sensitizing dye was incorporated after chemical ripening (the case where the sensitizing dye was incorporated after chemical ripening provides SY of 89 (not shown in the table)). After being stored at a high humidity and a high temperature, Experiment No. 1 Specimen showed a sensitivity drop of 5% and thus exhibited an effect as disclosed in U.S. Pat. No. 4,183,756 but showed a rise in fog (a specimen prepared in the same manner as in Method 1 except that no sensitizing dye was incorporated showed a fog density of 0.04). As shown in Experiment No. 2, the combined use of a known typical fog inhibitor cannot inhibit fogging and even increases fogging in many cases contrary to expectation. Even in the case where fogging was decreased, the specimen showed a lower sensitivity and exhibited a great sensitivity drop after being stored at a high humidity and a high temperature. On the other hand, the present method inhibits fogging, provides a higher sensitivity and gives an extremely small sensitivity and fog fluctuation after storage at a high humidity and a high temperature.

EXAMPLE 2

Method 4 (Comparative Example)

A monodisperse emulsion of octahedral silver bromoiodide grains (mean grain size: about 0.77 μm; variation coefficient: 10.6%; silver iodide content: 8.0 mol %; pH 6.0; pAg 8.5) was prepared in an ordinary manner in the presence of 3,4-dimethyl-4-thiazoline-2-thione (Emulsion 4). The emulsion was then subjected to gold-sulfur sensitization with an optimum amount of an aqueous solution of $Na_3Au(S_2O_3)_3$ at a temperature of 58° C. for 55 minutes.

Pendant Dye PS-19 was added to the emulsion thus prepared at a temperature of 40° C in an optimum amount ($6.7\times10^{-5}$ mol per mol of silver). After 15 minutes, an emulsion of the following magenta coupler and 4-hydroxy-6-methyl-1,3,3a,7-tetraazaindene were added to the emulsion. The material was then divided into two batches. 1,3-Bis(vinylsulfonyl)-2-propanol was then added to one of the two batches. This specimen was then coated on a polyethylene terephthalate film base. At the same time, an aqueous solution of gelatin containing a surface active agent and a viscosity increasing agent was coated on the upper layer of the emulsion layer as a protective layer. The other batch was then stored at a temperature of 40° C. for 8 hours, and coated on the same kind of a support.

Method 5 (Comparative Example)

Two kinds of coated specimens were prepared in the same manner as in Method 4 except that Sensitizing Dye A-3 and Fog Inhibitor A-4 were incorporated in the equimolecular amount to Pendant Dye PS-19 added in Emulsion 4, 5 minutes before the addition of $Na_3Au(S_2O_3)_3$ and Pendant Dye PS-19 was not incorporated after chemical ripening.

Method 6 (Present Invention)

Two kinds of coated specimens were prepared in the same manner as in Method 5 except that Pendant Dye PS-19 was incorporated in the equimolecular amount in place of sensitizing Dye A-3 and Fog Inhibitor A-4.

Magenta Coupler

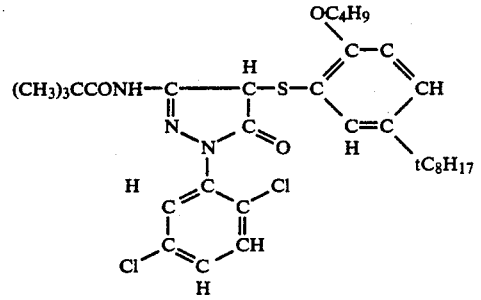

A-3

-continued

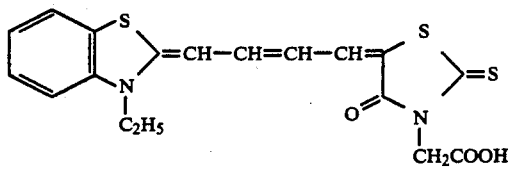

A-4

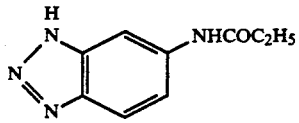

The above mentioned six kinds of coated specimens and specimens obtained by coating the three kinds of emulsions which had not been stored at a temperature of 40° C. for 8 hours on a support and storing the materials at a relative humidity of 75% and a temperature of 50° C. for 4 days were exposed to light from a tungsten lamp (color temperature: 2,854° K.) through a sharp cut filter (Fuji Photo Film Co., Ltd.) which transmits light of 600 nm and a continuous wedge for 1/10 second, developed in the following manner, and then measured for density to determine red sensitivity (SR) and fog. The reference point of the optical density at which the sensitivity was determined was [fog+0.5].

The results are set forth in Table 2.

-continued

| | |
|---|---|
| 4-(N-Ethyl-N-β-hydroxyethylamino)-2-methylaniline Sulfate | 4.5 g |
| Water to make | 1 liter |

Bleaching Solution

| | |
|---|---|
| Ammonium Bromide | 160.0 g |
| Aqueous Ammonia (28%) | 25.0 cc |
| Sodium Iron Ethylenediaminetetraacetate | 130.0 g |
| Glacial Acetic Acid | 14.0 cc |
| Water to make | 1 liter |

Fixing Solution

| | |
|---|---|
| Sodium Tetrapolyphosphate | 2.0 g |
| Sodium Sulfite | 4.0 g |
| Ammonium Thiosulfate (70%) | 175.0 cc |
| Sodium Bisulfite | 4.6 g |
| Water to make | 1 liter |

Stabilizing Solution

| | |
|---|---|
| Formalin | 8.0 cc |
| Water to make | 1 liter |

TABLE 2

| Experiment No. | Method No. | Red Sensitivity (SR) | Fog | After Being Stored at 75% RH, 50° C., 4 Days: Relative Red Sensitivity* | Fog | Emulsion Stored in Solution State: Relative Red Sensitivity* | Fog |
|---|---|---|---|---|---|---|---|
| 1 (Comparison) | 4 | 100 (reference) | 0.04 | 87 | 0.06 | 83 | 0.05 |
| 2 (Comparison) | 5 | 49 | 0.58 | 39 | 1.21 | 62 | 0.86 |
| 3 (Invention) | 6 | 132 | 0.03 | 100 | 0.03 | 98 | 0.03 |

*Value relative to that of the specimen prepared by coating on a support an emulsion which had not been stored in solution state at 40° C. for 8 hours and keeping the coated specimen out of the storage at a relative humidity of 75% and a temperature of 50° C.

These results show that the present method provides a higher sensitivity, a smaller sensitivity change before coating and during preservation after coating and an extremely small fog.

The development processing was effected at a temperature as follows:

| | |
|---|---|
| 1. Color Development | 3 min 15 sec |
| 2. Bleach | 6 min 30 sec |
| 3. Rinse | 3 min 15 sec |
| 4. Fixation | 6 min 30 sec |
| 5. Rinse | 3 min 15 sec |
| 6. Stabilization | 3 min 15 sec |

The processing solutions used at the various processes had the following compositions:

Color Developer

| | |
|---|---|
| Sodium Nitrilotriacetate | 1.0 g |
| Sodium Sulfite | 4.0 g |
| Sodium Carbonate | 30.0 g |
| Potassium Bromide | 1.4 g |
| Hydroxylamine Sulfate | 2.4 g |

In Method 5, if Fog Inhibitor A-4 was not incorporated, the coated specimen exhibited fog on the entire surface thereof and could not provide sensitivity. Even Azole Compound A-9 (shown below) containing a mercapto group and having a small solubility product of silver salt, which is said to exhibit a higher effect of inhibiting fog than A-4, must be used in a larger amount to inhibit fog. When fog was suppressed to 0.06, the red sensitivity was reduced to 47.

If a sensitizing dye for a long wavelength range such as a red light range and an infrared range is present during chemical ripening or grain formation as in this case, it is extremely likely to cause fog, making it difficult to maintain sufficient sensitivity and reduce fog. Therefore, the present method can be said to be more effective for a pendant dye comprising a sensitizing dye portion which is a sensitizing dye for a long wavelength range.

A-9

-continued

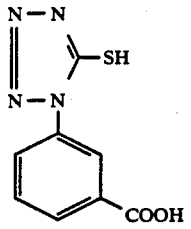

EXAMPLE 3

Method 7 (Comparative Example)

A silver chloride emulsion and silver bromochloride emulsions having silver chloride contents of 95 mol %, 80 mol %, 50 mol % and 30 mol %, respectively, were prepared in an ordinary manner. These five emulsions were monodisperse emulsions of cubic silver halide grains (mean side length: 0.45 to 0.49 μm; variation coefficient 9.7 to 11.2%). During the formation of grains, $K_2IrCl_6$ was added to the material in an amount of 0.05 mg per mol of silver. These five kinds of emulsions were then each divided into three batches. One of the three batches was then subjected to optimum chemical sensitization with chloroauric acid and sodium thiosulfate at a temperature of 55° C. and divided into batches. The pendant dyes as set forth in Tables 3 or 4 were added to these batches. After 15 minutes, sodium dodecylbenzenesulfonate, sodium p-sulfocinnamate homopolymer, and 4-hydroxy-6-methyl-1,3,3a,7-tetraazaindene were then added to the materials in amounts of 3.0 g, 4.0 g, and 0.5 g, respectively. Furthermore, the coupler emulsions as set forth in Tables 3 or 4 were then added to the materials. These coating materials were then coated on a paper support laminated with polyethylene on both sides thereof.

The coated amount of these emulsions were so adjusted that the amount of silver and gelatin reached 0.35 g/m$^2$ and 1.5 g/m$^2$, respectively. At the same time, on the upper layer was coated as a protective layer an aqueous solution of gelatin so that the amount of gelatin, sodium 1,2-bis(2-ethylhexylcarbonyl) ethanesulfonate, sodium dodecylbenzenesulfonate, sodium p-sulfocinnamate homopolymer, and 2,4-dichloro-6-hydroxy-1,3,5-triazine sodium reached 1.0 g/m$^2$, 7 mg/m$^2$, 13 mg/m$^2$, 7.5 mg/m$^2$, and 50 mg/m$^2$, respectively.

Method 8 (Comparative Example)

The sensitizing dyes set forth in Tables 3 or 4 were added to the second bath of the five kinds of emulsions. These specimens were then subjected to optimum chemical sensitization with chloroauric acid and sodium thiosulfate in the same manner as mentioned above. Various compounds were then added to the specimens in the same manner as mentioned above to prepare coated specimens.

Method 9 (Present Invention)

The pendant dyes set forth in Tables 3 or 4 were added to the rest of the batches of the five kinds of emulsions. These specimens were then subjected to optimum chemical sensitization in the same manner as mentioned above. Thus, coated specimens were prepared in the same manner as mentioned above.

A set of these 15 kinds of coated specimens were then stored at a relative humidity of 75% and a temperature of 50° C. for 3 days. These specimens were then subjected to light from a tungsten lamp (color temperature: 2,854° K.) through a sharp cut filter which transmits light of a wavelength longer than 600 nm and a continuous wedge for 1 second, developed in the following manner, and measured for density to determine sensitivity and fog. The reference point of the optical density at which the sensitivity was determined was [fog+0.5].

Tables 3 and 4 show the relative sensitivity of the specimens comprising the same kind of silver halide grains which had not been stored at a relative humidity of 75% and a temperature of 50° C. for 3 days and the relative sensitivity and fog of the same specimens which had been stored under the same conditions and another batch of the same specimens which had not been stored under the same conditions.

These light-sensitive materials were then imagewise exposed to light and developed in a paper processing machine in the following manner. A commercially available color paper was then continuously processed (running test) until the color developer was replenished twice the tank volume. The specimens which had not been stored at a relative humidity of 75% and a temperature of 50° C. for 3 days were developed. The sensitivity change was all within 2% among the same specimens. Many of these specimens showed no sensitivity change.

| Processing Step | Temperature (°C.) | Time (sec) | Replenishment Rate (ml) | Tank Volume (liter) |
|---|---|---|---|---|
| Color Development | 35 | 45 | 161 | 17 |
| Blix | 30–36 | 45 | 161 | 17 |
| Rinse 1 | 30–37 | 20 | — | 10 |
| Rinse 2 | 30–37 | 20 | — | 10 |
| Rinse 3 | 30–37 | 20 | 248 | 10 |
| Drying | 70–80 | 60 | | |

(per m$^2$ of light-sensitive material)

(The rinse was effected in a counter flow process in which the rinsing solution flows from the tank 3 to the tank 1 through the tank 2.)

The composition of the processing solutions was as follows:

Color Developer

| | Running Solution | Replenisher |
|---|---|---|
| Water | 800 ml | 800 ml |
| Ethylenediamine-N,N,N',N'-tetramethylenephosphonic Acid | 2.5 g | 2.5 g |
| Triethanolamine | 10 g | 10 g |
| Sodium Chloride | 1.4 g | — |
| Potassium Carbonate | 25 g | 25 g |
| N-Ethyl-N-(β-methanesulfonamidoethyl)-3-methyl-4-aminoaniline Sulfate | 5.0 g | 7.0 g |
| N,N-Bis(carboxymethyl)hydrazine | 4.2 g | 6.0 g |
| Fluorescent Brightening Agent (WHITEX-4; Sumitomo Chemical Co., Ltd.) | 1.0 g | 2.0 g |
| Water to make | 1,000 ml | 1,000 ml |
| pH (25° C.) | 10.05 | 10.45 |

Blix Solution (running solution has the same composition as replenisher)

| | |
|---|---|
| Water | 400 ml |
| Ammonium Thiosulfate (70%) | 100 ml |
| Sodium Sulfite | 17 g |
| Iron(III) Ammonium Ethylenediamine-tetraacetate | 55 g |
| Disodium Ethylenediaminetetraacetate | 5 g |
| Ammonium Bromide | 40 g |
| Glacial Acetic Acid | 9 g |
| Water to make | 1,000 ml |
| pH (25° C.) | 5.4 |

Washing Water

Both the running solution and the replenisher were prepared by passing tap water through a mixed bed column packed with an H-type strongly acidic cation exchange resin ("Amberlite IR-120B", produced by Rohm & Haas Co.) and an OH-type anion exchange resin ("Amberlite IR-400", produced by the same company) to reduce calcium and magnesium ion concentrations each to 3 mg/liter, and then adding to the resulting water 20 mg/liter of sodium dichloroisocyanate and 150 mg/liter of sodium sulfate.

The pH of the resulting solution was in the range of 6.5 to 7.5.

A-5

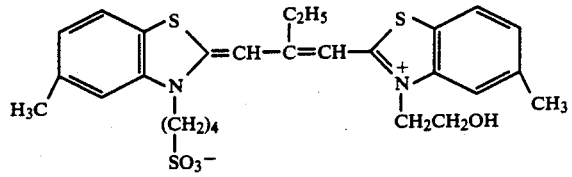

A-6

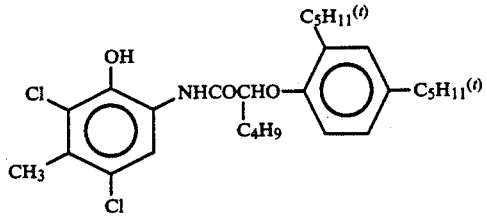

A-7

TABLE 3

The coupler incorporated in the specimens set forth in Table 3 was A-6 shown below.

| Experiment No. | Added Amount of Pendant Dye and Sensitizing Dye (× $10^{-4}$ mol/mol Ag) | | Cl Content in Silver Halide (mol %) | Method No. | Sensitivity | Fog | Stored at 75% RH, 50° C., 3 Days Relative Sensitivity | Fog |
|---|---|---|---|---|---|---|---|---|
| 1 (Comparison) | PS-11 | 8.5 | 100 | 7 | 1622 | 0.06 | 85 | 0.07 |
| 2 (Comparison) | A-5 | 8.5 | 100 | 8 | 100* | 0.13 | 10 | 0.57 |
| 3 (Invention) | PS-11 | 8.5 | 100 | 9 | 2844 | 0.04 | 95 | 0.05 |
| 4 (Comparison) | PS-11 | 8.5 | 95 | 7 | 1738 | 0.06 | 91 | 0.07 |
| 5 (Comparison) | A-5 | 8.5 | 95 | 8 | 100* | 0.10 | 45 | 0.31 |
| 6 (Invention) | PS-11 | 8.5 | 95 | 9 | 2188 | 0.04 | 95 | 0.04 |
| 7 (Comparison) | PS-11 | 8.5 | 80 | 7 | 339 | 0.05 | 95 | 0.07 |
| 8 (Comparison) | A-5 | 8.5 | 80 | 8 | 100* | 0.09 | 78 | 0.16 |
| 9 (Invention) | PS-11 | 8.5 | 80 | 9 | 525 | 0.04 | 98 | 0.05 |
| 10 (Comparison) | PS-11 | 8.5 | 50 | 7 | 123 | 0.05 | 98 | 0.06 |
| 11 (Comparison) | A-5 | 8.5 | 50 | 8 | 100 | 0.08 | 91 | 0.10 |
| 12 (Invention) | PS-11 | 8.5 | 50 | 9 | 138 | 0.04 | 98 | 0.04 |
| 13 (Comparison) | PS-11 | 8.5 | 30 | 7 | 102 | 0.04 | 98 | 0.05 |
| 14 (Comparison) | A-5 | 8.5 | 30 | 8 | 100* | 0.06 | 95 | 0.07 |
| 15 (Invention) | PS-11 | 8.5 | 30 | 9 | 112 | 0.04 | 100 | 0.04 |

*Reference

TABLE 4

| Experiment No. | Cl Content in Silver Halide (mol %) | Method No. | Sensitivity | Fog | Stored at 75% RH, 50° C., 3 Days Relative Sensitivity | Fog |
|---|---|---|---|---|---|---|
| 16 (Comparison) | 100 | 7 | 100 (reference) | 0.12 | 79 | 0.14 |
| 17 (Invention) | 100 | 9 | 151 | 0.10 | 89 | 0.11 |
| 18 (Comparison) | 95 | 7 | 100 (reference) | 0.11 | 83 | 0.13 |
| 19 (Invention) | 95 | 9 | 141 | 0.08 | 89 | 0.11 |
| 20 (Comparison) | 80 | 7 | 100 (reference) | 0.11 | 85 | 0.12 |
| 21 (Invention) | 80 | 9 | 129 | 0.08 | 91 | 0.09 |
| 22 (Comparison) | 50 | 7 | 100 (reference) | 0.09 | 89 | 0.10 |
| 23 (Invention) | 50 | 9 | 123 | 0.08 | 93 | 0.09 |
| 24 (Comparison) | 30 | 7 | 100 (reference) | 0.09 | 89 | 0.09 |
| 25 (Invention) | 30 | 9 | 117 | 0.08 | 93 | 0.08 |

Note: All the specimens set forth in Table 4 comprise Pendant Dye PS-20 in an amount of $1.3\times10^{-5}$ mol/mol silver and the following Coupler A-7:

-continued

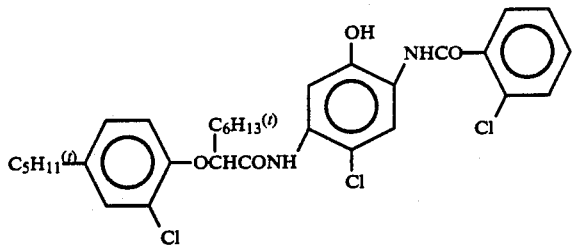

The results set forth in Tables 3 and 4 show that the methods of the present invention are excellent. In general, as the silver chloride content on the surface of silver halide grains increases, a cyanine dye reduces its adsorption and spectral sensitizing effect. (For example, in Table 3, the sensitivity obtained in Experiment No. 2 was about 3/100 of that obtained in Experiment No. 14.)

The use of the pendant adsorption enables a higher adsorption. This effect becomes more remarkable as the silver chloride content of the silver halide grains becomes higher.

A specimen obtained by incorporating in Method 8 the following Sensitizing Dye A-8 instead of Pendant Dye PS-20 before chemical ripening and coating the coating emulsion on a support exhibited fog on the entire surface thereof and could not provide sensitivity. Thus, in accordance with the present method, a color sensitizing effect can be provided with a high sensitivity and aging stability without any remarkable fog as shown in Table 4.

EXAMPLE 4

Method 10 (Comparative Example)

A silver chloride emulsion was prepared in just the same manner as for the silver chloride emulsion used in Example 3, in accordance with an ordinary manner disclosed in JP-A-63-239449. The silver chloride emulsion was subjected to optimum chemical sensitization with sodium thiosulfate at 55° C. and then divided into four batches. To these batches Pendant Dyes PS-14 and PS-30 to PS-32 were added, respectively, at 40° C. in amounts indicated in Table 5 below. The resulting four coating materials each was coated on a paper support laminated with polyethylene on both sides in just the same manner as in Method 7 of Example 3.

Method 11 (Present Invention)

Four coating materials were prepared in just the same manner as in Method 10 except that, unlike in Method 10, Pendant Dyes PS-14 and PS-30 to PS-32 each was added to the material 2 minutes after completion of the addition of an aqueous silver nitrate during the preparation of a silver chloride emulsion.

The resulting four coating materials were used to coat in just the same manner as in Method 10.

Method 12 (Present Invention)

Four coating materials were prepared in just the same manner as in Method 10 except that, unlike in Method 10, Pendant Dyes PS-14 and PS-30 to PS-32 each was added to a silver chloride emulsion 3 minutes before the addition of sodium thiosulfate.

The resulting four coating materials were used to coat in just the same manner as in Method 10.

Method 13 (Present Invention)

Four coating materials were prepared in just the same manner as in Method 10 except that, unlike in Method 10, Pendant Dyes PS-14 and PS-30 to PS-32 each was added to a silver emulsion 3 minutes after the addition of sodium thiosulfate.

The resulting four coating materials were used to coat in just the same manner as in Method 10.

One set of these 16 kinds of coated specimens were stored at 50° C for 3 days at a relative humidity of 80% and the other set of these 16 were stored at room temperature for 3 days.

All these specimens were sensitometrically exposed, developed and tested for sensitivity and fog.

The results are shown in Table 5. In Table 5, the sensitivity of the specimens stored at 50° C. under a relative humidity of 80% is shown in terms of the relative sensitivity with the sensitivity of the corresponding coated specimens which have not been stored at 50° C. under a relative humidity of 80%, taken as 100. The sensitivity of the specimens stored at room temperature is shown with the sensitivity of each of the specimens prepared by Method 10 taken as 100.

The results in Table 5 indicate that the methods of the present invention are excellent.

In accordance with the method of the present invention, a color sensitizing effect can be provided with a high sensitivity and aging stability without any remarkable fog as shown in Table 5.

TABLE 5

| Experiment No. | Pendant Dyes No. | Pendant Dyes Amount Added ($\times 10^{-4}$ mol/mol-Ag) | Method No. | Sensitivity | Fog | Stored at 80% RH, 50° C., 3 Days Relative Sensitivity | Stored at 80% RH, 50° C., 3 Days Fog |
|---|---|---|---|---|---|---|---|
| 1 (Comparison) | PS-30 | 1.2 | 10 | 100 (reference) | 0.07 | 85 | 0.09 |
| 2 (Invention) | PS-30 | 1.2 | 11 | 204 | 0.04 | 97 | 0.04 |
| 3 (Invention) | PS-30 | 1.2 | 12 | 195 | 0.05 | 98 | 0.05 |
| 4 (Invention) | PS-30 | 1.2 | 13 | 182 | 0.05 | 95 | 0.06 |
| 5 (Comparison) | PS-31 | 2.0 | 10 | 100 (reference) | 0.07 | 76 | 0.11 |
| 6 (Invention) | PS-31 | 2.0 | 11 | 282 | 0.05 | 97 | 0.05 |
| 7 (Invention) | PS-31 | 2.0 | 12 | 257 | 0.05 | 95 | 0.06 |
| 8 (Invention) | PS-31 | 2.0 | 13 | 224 | 0.06 | 95 | 0.06 |
| 9 (Comparison) | PS-14 | 0.8 | 10 | 100 (reference) | 0.07 | 89 | 0.14 |
| 10 (Invention) | PS-14 | 0.8 | 11 | 229 | 0.07 | 95 | 0.07 |
| 11 (Invention) | PS-14 | 0.8 | 12 | 295 | 0.05 | 97 | 0.06 |
| 12 (Invention) | PS-14 | 0.8 | 13 | 263 | 0.06 | 95 | 0.07 |
| 13 (Comparison) | PS-32 | 1.1 | 10 | 100 (reference) | 0.07 | 85 | 0.09 |
| 14 (Invention) | PS-32 | 1.1 | 11 | 741 | 0.05 | 98 | 0.05 |
| 15 (Invention) | PS-32 | 1.1 | 12 | 832 | 0.05 | 98 | 0.05 |

TABLE 5-continued

| Experiment No. | Pendant Dyes No. | Pendant Dyes Amount Added ($\times 10^{-4}$ mol/mol-Ag) | Method No. | Sensitivity | Fog | Stored at 80% RH, 50° C., 3 Days Relative Sensitivity | Stored at 80% RH, 50° C., 3 Days Fog |
|---|---|---|---|---|---|---|---|
| 16 (Invention) | PS-32 | 1.1 | 13 | 617 | 0.05 | 97 | 0.06 |

While the invention has been described in detail and with reference to specific embodiments thereof, it will be apparent to one skilled in the art that various changes and modifications can be made therein without departing from the spirit and scope thereof. For example, the compound which constitutes the pendant dye and exhibits an effect of inhibiting fog may be a fog inhibitor represented by the general formula (II-1). The pendant dye may be represented by the general formula (IV). In the general formula, $l^1/l^3$ may be 2/1 to ½ and $l^4$ may be 0 or 1. The silver halide grains may comprise those having a silver chloride content of 50 mol % or more, preferably 80 mol % or more, more preferably 95 mol % or more in a proportion of 60% or more, preferably 70% or more as calculated in terms of total projected area or surface area thereof. The silver halide grains may also comprise tabular silver halide grains having an aspect ratio of 2 or more, preferably 4 to 20 in a proportion of 70% or more, preferably 90% or more as calculated in terms of total projected area thereof. The compound which constitutes the pendant dye and exhibits the effect of inhibiting fog may be a compound represented by the general formula (VII), (VIII), (IX), (X) or (XI). The sensitizing dye portion may be a compound represented by the general formula (V) or (VI).

What is claimed is:

1. A process for the preparation of a silver halide photographic emulsion, which comprises the addition of at least one pendant spectral sensitizing dye containing as a substituent a compound having the effect of inhibiting fog at any time following the formation of silver halide grains, but before the completion of the chemical ripening process, wherein the compound having the effect of inhibiting fog is an azaindene group, an azole group, or an azole containing a mercapto group.

2. The process as in claim 1, wherein the compound having the effect of inhibiting fog is represented by the general formula (VII):

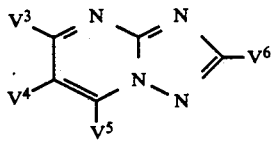

(VII)

wherein $V^3$, $V^4$, $V^5$ and $V^6$ each represents a hydrogen atom or a substituted or unsubstituted alkyl group, a substituted or unsubstituted alkenyl group, a substituted or unsubstituted aryl group, a substituted or unsubstituted heterocyclic group, a halogen atom, a mercapto group, a cyano group, a carboxyl group, a sulfo group, a hydroxyl group, a carbamoyl group, a sulfamoyl group, an amino group, a nitro group, a substituted or unsubstituted alkoxy group, a substituted or unsubstituted aryloxy group, an acyl group, an acylamino group, a substituted amino group, an alkyl or arylthio group, an alkoxycarbonyl group, and an aryloxcarbonyl group; $V^3$, $V^4$, $V^5$ and $V^6$ each may also represent a divalent connecting group L, or a bond; wherein L represents a divalent connecting group which is an atom or an atomic group comprising at least one C, N, S or O atom.

3. The process as in claim 1, wherein the compound having the effect of inhibiting fog is represented by the general formula (VIII):

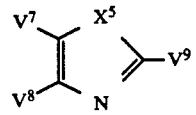

(VIII)

wherein $X^5$ represents an oxygen atom, a sulfur atom or $>N—R^6$; $R^6$ represents a hydrogen atom, a substituted or unsubstituted alkyl group, a substituted or unsubstituted aryl group, or a substituted or unsubstituted heterocyclic group;

$V^7$, $V^8$ and $V^9$ each represents a hydrogen atom or a substituted or unsubstituted alkyl group, a substituted or unsubstituted alkenyl group, a substituted or unsubstituted aryl group, a substituted or unsubstituted heterocyclic group, a halogen atom, a mercapto group, a cyano group, a carboxyl group, a sulfo group, a hydroxyl group, a carbamoyl group, a sulfamoyl group, an amino gorup, a nitro group, a substituted or unsubstituted alkoxy group, a substituted or unsubstituted aryloxy group, an acyl group, an acylamino group, a substituted amino group, an alkyl or arylthio group, an alkoxycarbonyl group, and an aryloxcarbonyl group; $V^7$, $V^8$ and $V^9$ each may also represent a divalent connecting group L or a bond; wherein L represents a divalent connecting group which is an atom or an atomic group comprising at least one C, N, S or O atom; $V^7$ and $V^8$ may together form a benzo or naphthol condensed ring which may be substituted.

4. The process as in claim 1, wherein the compound having the effect of inhibiting fog is represented by the general formula (IX):

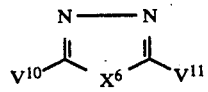

(IX)

wherein $X^6$ represents an oxygen atom, a sulfur atom or $N—R^7$ in which $R^7$ represents a hydrogen atom, a substituted or unsubstituted alkyl group, a substituted or unsubstituted aryl group, or a substituted or unsubstituted heterocyclic group;

$V^{10}$ $V^{11}$ each represents a hydrogen atom or a substituted or unsubstituted alkyl gorup, a substituted or unsubstituted alkenyl group, a substituted or unsubstituted aryl group, a substituted or unsubstituted heterocyclic group, a halogen atom, a mercapto group, a cyano group, a carboxyl group, a sulfo group, a hydroxyl group, a carbamoyl group, a sulfamoyl group, an amino group, a nitro group, a substituted or unsubstituted alkoxy group, a substituted or unsubstituted aryloxy group, an acyl group, an acylamino group, a substituted amino group, an alkyl or arylthio group, an alkoxycarbonyl group, and an aryloxcarbonyl group; $V^{10}$ and $V^{11}$ each may also represent a divalent connecting group L or a bond; wherein L represents a divalent connecting group which is an atom or an atomic group comprising at least one C, N, S or O atom.

5. The process as in claim 1, wherein the compound having the effect of inhibiting fog is represented by the general formula (X):

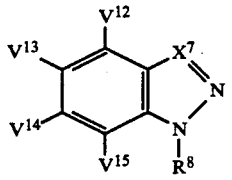

(X)

wherein $X^7$ represents a nitrogen atom or C—$R^9$; $R^8$ and $R^9$ represents a hydrogen atom, a substituted or unsubstituted alkyl group, a substituted or unsubstituted aryl group, or a substituted or unsubstituted heterocyclic group;

$V^{12}$, $V^{13}$, $V^{14}$ and $V^{15}$ each represents a hydrogen atom or a substituted or unsubstituted alkyl gorup, a substituted or unsubstituted alkenyl group, a substituted or unsubstituted aryl group, a substituted or unsubstituted heterocyclic group, a halogen atom, a mercapto group, a cyano group, a carboxyl group, a sulfo group, a hydroxyl group, a carbamoyl group, a sulfamoyl group, an amino group, a nitro group, a substituted or unsubstituted alkoxy group, a substituted or unsubstituted aryloxy group, an acyl group, an acylamino group, a substituted amino group, an alkyl or arylthio group, an alkoxycarbonyl group, and an aryloxcarbonyl group; $V^{12}$, $V^{13}$, $V^{14}$ and $V^{15}$ each may also represent a divalent connecting group L or a bond; wherein L represents a divalent connecting group which is an atom or an atomic group comprising at least one C, N, S or O atom.

6. The process as in claim 1, wherein the compound having the effect of inhibiting fog is represented by the general formula (XI):

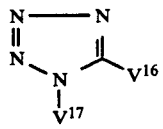

(XI)

wherein $V^{16}$ and $V^{17}$ each represents a hydrogen atom or a substituted or unsubstituted alkyl group, a substituted or unsubstituted alkenyl group, a substituted or unsubstituted aryl group, a substituted or unsubstituted heterocyclic group, a halogen atom, a mercapto group, a cyano group, a carboxyl group, a sulfo group, a hydroxyl group, a carbamoyl gorup, a sulfamoyl group, an amino group, a nitro group, a substituted or unsubstituted alkoxy group, a substituted or unsubstituted aryloxy group, an acyl group, an acylamino group, a substituted amino group, an alkyl or arylthio group, an alkoxycarbonyl group, and an aryloxcarbonyl group; $V^{16}$ and $V^{17}$ each may also represent a divalent connecting group L or a bond; wherein L represents a divalent connecting group which is an atom or an atomic group comprising at least one C, N, S or O atom.

* * * * *